US012800181B2

(12) United States Patent
Bortoff et al.

(10) Patent No.: US 12,800,181 B2
(45) Date of Patent: Nov. 17, 2026

(54) SYSTEM AND METHOD FOR SIMULTANEOUS CONTROL OF TEMPERATURE AND RELATIVE HUMIDITY OF A CONDITIONED SPACE

(71) Applicant: Mitsubishi Electric Research Laboratories, Inc., Cambridge, MA (US)

(72) Inventors: Scott Bortoff, Brookline, MA (US); Hongtao Qiao, Wakefield, MA (US); Christopher Laughman, Waltham, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 118 days.

(21) Appl. No.: 18/913,668

(22) Filed: Oct. 11, 2024

(65) Prior Publication Data

US 2026/0049739 A1 Feb. 19, 2026

Related U.S. Application Data

(60) Provisional application No. 63/683,274, filed on Aug. 15, 2024.

(51) Int. Cl.

| | |
|---|---|
| ***F24F 11/86*** | (2018.01) |
| ***F24F 11/67*** | (2018.01) |
| *F24F 110/10* | (2018.01) |
| *F24F 110/20* | (2018.01) |

(52) U.S. Cl.

CPC ..... *F24F 11/86* (2018.01); *F24F 11/67* (2018.01); *F24F 2110/10* (2018.01); *F24F 2110/20* (2018.01)

(58) Field of Classification Search

CPC ..... F24F 11/86; F24F 11/67; F24F 2110/10; F24F 2110/20

USPC ..... 62/228.1

See application file for complete search history.

(56) References Cited

U.S. PATENT DOCUMENTS

| | | | | |
|---|---|---|---|---|
| 6,170,271 | B1 * | 1/2001 | Sullivan | F24F 3/153 62/93 |
| 6,612,119 | B2 | 9/2003 | Eber et al. | |
| 8,757,506 | B2 | 6/2014 | Zhou et al. | |
| 10,495,364 | B2 | 12/2019 | Merl | |
| 2020/0018500 | A1 * | 1/2020 | Jeong | F24F 11/0001 |

* cited by examiner

*Primary Examiner* — Nael N Babaa
(74) *Attorney, Agent, or Firm* — Gene Vinokur

(57) ABSTRACT

The present disclosure provides a system and a method for controlling a multi-mode heat pump having a vapor compression cycle configured to condition a space. The method comprises computing a first first psychrometric variable and a second psychrometric variable based on a current temperature, a setpoint temperature, a current relative humidity, and a setpoint relative humidity of the space, via a psychrometric coordinate transformation. The method further comprises controlling, based on the first psychrometric variable, an expansion valve and a speed of a compressor of the multi-mode heat pump to reduce a magnitude of the first psychrometric variable to a predefined value, and controlling, based on the second psychrometric variable, a speed of at least one of an outdoor fan and an indoor fan of the multi-mode heat pump to reduce a magnitude of the second psychrometric variable to a predefined value.

20 Claims, 33 Drawing Sheets

$$\rho = \overbrace{(T_r - \bar{T}_r)}^{2201} - \underbrace{\alpha}_{2202} \cdot \overbrace{(\phi - \bar{\phi})}^{2203}$$

Figure 22B

SYSTEM AND METHOD FOR SIMULTANEOUS CONTROL OF TEMPERATURE AND RELATIVE HUMIDITY OF A CONDITIONED SPACE

TECHNICAL FIELD

The present disclosure relates generally to control systems, and more specifically to a system and a method for simultaneous control of temperature and relative humidity of a conditioned space.

BACKGROUND

Vapor compression systems, such as heat pumps, refrigeration, and air-conditioning systems, are widely used in industrial and residential applications. The heat pump provides heating or cooling to a space using a vapor compression cycle to move heat from a lower temperature fluid to a higher temperature fluid. The space may be one or more rooms within a building, for example. The heat pump may operate in one or more modes, such as a heating mode or a cooling mode, for example. When operating in a cooling mode, the heat pump removes both sensible heat (reducing dry bulb temperature) and latent heat through condensation (reducing absolute humidity) from air in the space. When operating in a heating mode, the heat pump adds sensible heat to the space (increasing the dry bulb temperature).

Introduction of variable speed compressors, variable position valves, and variable speed fans to a vapor compression cycle has greatly improved the flexibility of operation of a heat pump. Control inputs are provided to such variable components of the heat pump to regulate a space air temperature or a space relative humidity, for example. The temperature and the relative humidity of the space may be controlled at different time instances. For example, at first, the space temperature may be regulated, and at another time, the space relative humidity may be regulated, or vice versa. However, such a control of the temperature and the relative humidity does not simultaneously regulate both variables, so that one may change from a desired setpoint while the other is being regulated.

Therefore, there is still a need for a system and a method for simultaneously controlling the temperature and the relative humidity of the space.

SUMMARY

It is an objective of some embodiments to provide a control system for controlling a multi-mode heat pump that can operate in cooling mode and a reheat mode to condition a space. In particular, it is an objective of some embodiments to provide a control system for a multi-mode heat pump, which can simultaneously control temperature and relative humidity of a conditioned space to achieve a setpoint temperature and a setpoint relative humidity of the conditioned space. The setpoint temperature and the setpoint relative humidity of the conditioned space corresponds to a desired temperature and relative humidity of the conditioned space.

It is also an objective of some embodiments to provide a control system that can simultaneously control the temperature and the relative humidity of a conditioned space and reject a large range of sensible and latent heat loads, while avoiding overcooling and on-off cycling of a multi-mode heat pump. Additionally, it is an objective of some embodiments to provide a control system that can simultaneously control the temperature and the relative humidity of a conditioned space and reject a large range of sensible and latent heat loads, while avoiding overcooling and on-off cycling of a multi-mode heat pump and avoiding a condition of low indoor fan speeds at high values of temperature and relative humidity setpoint errors.

Some embodiments are based on the observations that in a cooling mode, an increase in the speed of a compressor of a multi-mode heat pump results in a decrease in the temperature of the conditioned space $T_r$, but may result in an increase in the relative humidity of the conditioned space $\phi_r$. Further, in a cooling mode, an increase the speed of an indoor fan of a multi-mode heat pump results in a decrease in the temperature $T_r$, and also in an increase in the relative humidity $\phi_r$. Some embodiments are based on further observations that in a reheat mode, an increase in the speed of the compressor results in a decrease in the temperature $T_r$, and also a decrease in the relative humidity $\phi_r$. Further, in a reheat mode, an increase in the speed of the indoor fan results in a decrease in the temperature $T_r$, and also an increase in the relative humidity $\phi_r$.

The aforesaid observations may be represented on a ($\Delta T_r$, $\Delta\phi_r$)-plane to make clear an effect of increasing or decreasing a compressor speed, or of increasing or decreasing an indoor fan speed, on the space temperature and space relative humidity, in a cooling mode. Further, the aforesaid observations may be represented on a ($\Delta T_r$, $\Delta\phi_r$)-plane to make clear an effect of increasing or decreasing a compressor speed, or increasing or decreasing an indoor fan speed, or increasing or decreasing an outdoor fan speed, on the space temperature and relative humidity, in a reheat mode. $\Delta T_r$ refers to a difference between the current temperature of the conditioned space and the setpoint temperature. $\Delta\phi_r$ refers to a difference between the current relative humidity of the conditioned space and the setpoint relative humidity. Directions of vectors of an increasing or decreasing compressor speed, an increasing or decreasing indoor fan speed, or an increasing or decreasing outdoor fan speed, in a cooling mode and a reheat mode, are computed from a simulation model of a multi-mode heat pump operating in a cooling mode or a reheat mode.

Some embodiments are based on the recognition that the directions of aforesaid vectors are not aligned with $\Delta T_r$ direction, or $\Delta\phi_r$ direction and therefore difficult to drive the temperature and the relative humidity to their setpoints. Further, use of ($\Delta T_r$, $\Delta\phi_r$) as feedback variables to control the compressor speed and the indoor fan speed may result in an overcooled state of the conditioned space, if only the cooling mode is used, and that switch to the reheat mode must be made prior to reaching the overcooled state.

Some embodiments are based on the realization that psychrometric variables ($\sigma$, $\rho$) can be computed and defined to be better aligned with the directions of the aforesaid vectors, compared to ($\Delta T_r$, $\Delta\phi_r$). The psychrometric variables ($\sigma$, $\rho$) are computed by a psychrometric coordinate transformation $$(\sigma, \rho) = P(T_r, \bar{T}_r, \phi_r, \bar{\phi}_r) \tag{a}$$

where the psychrometric coordinate transformation P: $R^4 \rightarrow R^2$ is mathematically one-to-one and onto from ($T_r$, $\phi_r$) to ($\sigma$, $\rho$), (in order to ensure P defines a well-defined, singularity-free coordinate transformation), and satisfies $$P(T_r, T_r, \phi_r, \phi_r) = (0, 0) \quad \text{(b)}$$

and $$(\sigma(T_2, \phi_1) - \sigma(T_1, \phi_1)) \cdot (\sigma(T_1, \phi_2) - \sigma(T_1, \phi_1)) > 0 \quad \text{(c)}$$

and $$(\rho(T_2, \phi_1) - \rho(T_1, \phi_1)) \cdot (\rho(T_1, \phi_2) - \sigma(T_1, \phi_1)) < 0, \quad \text{(d)}$$

for all conditioned space temperature values $T_1$ and $T_2$ satisfying $T_1<T_2$ and for all conditioned space relative humidity values $\phi_1$ and $\phi_2$ satisfying $\phi_1<\phi_2$, in an operating range U, used in a feedback configuration, results in a smaller overcooled region, $O_p$, contained in U, compared to an overcooled region O obtained by using variables ($\Delta T_r$, $\Delta\phi_r$).

Equations (b), (c) and (d) are used to compute the psychrometric variables ($\sigma$, $\rho$) as a function of $T_r$, $\overline{T}_r$, $\phi_r$ and $\overline{\phi}_r$ via the psychrometric coordinate transformation P. Equations (c) and (d) mean that, for given values of setpoint temperature $\overline{T}_r$ and setpoint relative humidity $\overline{\phi}_r$, either 1. $\sigma$ increases when $T_r$ increases and $\sigma$ increases when $\phi_r$ increases, and $\rho$ increases when $T_r$ increases and $\rho$ decreases when $\phi_r$ increases, or
2. $\sigma$ decreases when $T_r$ increases and $\sigma$ decreases when $\phi_r$ increases, and $\rho$ decreases when $T_r$ increases and $\rho$ increases when $\phi_r$ increases.

Any variables ($\sigma$, $\rho$) that satisfy one of these two conditions are denoted as the psychrometric variables. The psychrometric variables also satisfy $\rho=0$ and $\sigma=0$ when $T_r=\overline{T}_r$ and $\phi_r=\overline{\phi}_r$, which is implied by equation (b).

As such, a control system for a multi-mode heat pump that incorporates psychrometric variables ($\sigma$, $\rho$) can cause the multi-mode heat pump to operate over a larger region of U to simultaneously control the temperature and the relative humidity. Some embodiments are based on the realization that the psychrometric variables can be used to redefine an overcooled region to be a smaller region of U. This realization allows for the multi-mode heat pump to continue to operate in the reheat mode for some conditions in which $\Delta T_r<0$ but $\Delta\phi_r>0$, and ultimately drive the temperature and the relative humidity to values at or near their setpoints.

Some embodiments are based on the realization that the psychrometric variables ($\sigma$, $\rho$) in a feedback configuration improves decoupling between the directions corresponding to the compressor speed (CF) and both indoor fan speed (IFS) and outdoor fan speed (OFS). In the reheat mode, the CF direction is well aligned with $\sigma$, but has little affect on $\rho$, while both IFS and OFS are well aligned with $\rho$, but have little affect upon $\sigma$. In the cooling mode, the CF direction is well aligned with $\rho$.

Some embodiments are based on further realization that the OFS is effective in increasing the range of sensible and latent heat loads that may be rejected, particularly at values of low IFS. Therefore, some embodiments are based on the realization that both the IFS and OFS can be used to simultaneously control the conditioned space temperature and the conditioned space relative humidity, by using the IFS until it reaches a minimum constraint, and then using the OFS, where it is effective.

As such, some embodiments employ two feedback loops, namely, a first feedback loop and a second feedback loop. The first feedback loop is defined to include a psychrometric coordinate transformation which produces as output a first psychrometric variable $\sigma$. The first psychrometric variable $\sigma$ is used as input to a compressor or electronic expansion valve (EEV) compensator, which produces a value for the compressor speed. The compressor/EEV compensator may also provide a value for one or more EEVs, in order to regulate a process variable associated with the multi-mode heat pump, such as an evaporator super heat or a compressor discharge temperature. The first feedback loop causes $\sigma$ to converge to 0 or nearly 0. In some embodiments, the compressor/EEV compensator produces a value for an outdoor EEV in the cooling mode. In some other embodiments, the compressor/EEV compensator produces a value for an indoor EEV in the reheat mode.

The second feedback loop is defined to include the psychrometric coordinate transform P which produces a second psychrometric variable $\rho$. The second psychrometric variable $\rho$ is used as input to a fan speed compensator, which produces a value for one or more indoor fan speeds and one or more outdoor fan speeds. The second feedback loop causes the second psychrometric variable $\rho$ to converge to 0 or nearly 0.

In some embodiments, the fan speed compensator produces values for the IFS and the OFS in a prioritized manner, such that the IFS value remains within a range of allowable values, and the OFS remains within a range of allowable values. Further, the fan speed compensator may produce values of IFS and OFS such that IFS is prioritized over the OFS, such that the IFS value is computed as a function of the second psychrometric variable $\rho$ while the IFS remains within a range of allowable values, and the OFS is kept at a constant value. However if the IFS value is at or near a minimum value, then the OFS value is computed as a function of the second psychrometric variable $\rho$.

Some embodiments are based on the realization that the combined effect of both the first and the second feedback loops simultaneously drive both the first psychrometric variable $\sigma$ to zero and the second psychrometric variable $\rho$ to zero, thereby simultaneously drives both the room temperature $T_r$ to its setpoint $\overline{T}_r$ and the conditioned space relative humidity $\phi_r$ to its setpoint $\overline{\phi}_r$.

Some embodiments are based on the realization that switching among a cooling mode, a reheat mode and an off mode can be automated by logic, defined with psychrometric variables ($\sigma$, $\rho$). For example, a multi-mode heat pump is operated in a cooling mode when $\rho>0$ and $\Delta T_r>0$, or in a reheat mode when $p<0$ and $\sigma>0$, or otherwise in an off mode. Some embodiments may incorporate a threshold instead of zero, or incorporate hysteresis into these switching logics, to prevent cycling or rapid switching between the modes of operation. Some embodiments may incorporate timing constraints or limits into the switching logics, to maintain operation in a mode for a period of time.

Accordingly, one embodiment discloses a feedback controller for controlling a multi-mode heat pump having a vapor compression cycle configured to operate as a multi-mode heat pump in a cooling mode or a reheat mode to condition a space. The feedback controller comprises a processor configured to compute a first psychrometric variable and a second psychrometric variable based on a current temperature, a setpoint temperature, a current relative humidity, and a setpoint relative humidity of the space, via a psychrometric coordinate transformation; and a circuitry forming modules of the feedback controller. The modules comprising: a first feedback loop configured to control, based on the first psychrometric variable, at least one of an expansion valve and a speed of a compressor of the multi-mode heat pump to reduce a magnitude of the first psychrometric variable to a predefined value; a second feedback loop configured to control, based on the second psychrometric variable, a speed of at least one of an outdoor fan and an indoor fan of the multi-mode heat pump to reduce a magnitude of the second psychrometric variable to a predefined value; and a switcher configured to operate the vapor compression cycle of the multi-mode heat pump in the cooling mode when the second psychrometric variable is greater than a threshold and the difference between the current temperature and the setpoint temperature is greater than a threshold, or the reheat mode when the first psychrometric variable is greater than a threshold and the second psychrometric variable is less than a threshold.

Accordingly, another embodiment discloses a method for controlling a multi-mode heat pump having a vapor compression cycle configured to operate the multi-mode heat pump in a cooling mode or a reheat mode to condition a space. The method comprises computing a first first psychrometric variable and a second psychrometric variable based on a current temperature, a setpoint temperature, a current relative humidity, and a setpoint relative humidity of the space, via a psychrometric coordinate transformation; controlling, based on the first psychrometric variable, at least one of an expansion valve and a speed of a compressor of the multi-mode heat pump to reduce a magnitude of the first psychrometric variable to a predefined value; controlling, based on the second psychrometric variable, a speed of at least one of an outdoor fan and an indoor fan of the multi-mode heat pump to reduce a magnitude of the second psychrometric variable to a predefined value; and operating the vapor compression cycle of the multi-mode heat pump in the cooling mode when the second psychrometric variable is greater than a threshold and the difference between the current temperature and the setpoint temperature is greater than a threshold, or the reheat mode when the first psychrometric variable is greater than a threshold and the second psychrometric variable is less than a threshold.

Accordingly, yet another embodiment discloses a control system for controlling a heat pump configured to condition a space, wherein the heat pump includes an indoor unit and an outdoor unit, the indoor unit includes an indoor variable speed fan and an indoor expansion valve, and the outdoor unit includes a compressor, an outdoor fan, and an outdoor expansion valve. The control system comprises an input interface configured to receive a current temperature, a setpoint temperature, a current relative humidity, and a setpoint relative humidity of the space; a psychrometric coordinate transformer configured to determine a first psychrometric variable and a second psychrometric variable based on the current temperature, the setpoint temperature, the current relative humidity, and the setpoint relative humidity of the space, via a psychrometric coordinate transformation; a compressor compensator configured to determine, based on the first psychrometric variable, a speed of the compressor and a value for each of the indoor expansion valve and the outdoor expansion valve; a fan speed compensator configured to determine, based on the second psychrometric variable, a speed of the indoor fan and a speed of the outdoor fan; a controller configured to: control the compressor, the indoor expansion valve, and the outdoor expansion valve based on the determined speed of the compressor and the value for each of the indoor expansion valve and the outdoor expansion valve, to reduce a magnitude of the first psychrometric variable to a predefined value; and control the indoor fan and the outdoor based on the determined speed of the indoor fan and the speed of outdoor fan, respectively, to reduce a magnitude of the second psychrometric variable to a predefined value; and a mode controller configured to operate the heat pump in a cooling mode when the second psychrometric variable is greater than a threshold and a difference between the current temperature and the setpoint temperature is greater than a threshold, or a reheat mode when the first psychrometric variable is greater than a threshold and the second psychrometric variable is less than a threshold.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

FIG. 22B illustrates an equation for defining the second psychrometric variable, according to some embodiments of the present disclosure.

DETAILED DESCRIPTION

In the following description, for purposes of explanation, numerous specific details are set forth in order to provide a thorough understanding of the present disclosure. It will be apparent, however, to one skilled in the art that the present disclosure may be practiced without these specific details. In other instances, apparatuses and methods are shown in block diagram form only in order to avoid obscuring the present disclosure.

As used in this specification and claims, the terms "for example," "for instance," and "such as," and the verbs "comprising," "having," "including," and their other verb forms, when used in conjunction with a listing of one or more components or other items, are each to be construed as open ended, meaning that that the listing is not to be considered as excluding other, additional components or items. The term "based on" means at least partially based on. Further, it is to be understood that the phraseology and terminology employed herein are for the purpose of the description and should not be regarded as limiting. Any heading utilized within this description is for convenience only and has no legal or limiting effect.

Problem Overview

A heat pump provides heating or cooling to a conditioned space using a closed vapor compression cycle to move heat from a lower temperature fluid to a higher temperature fluid. The heat pump may operate in one or more modes, such as a heating mode or a cooling mode, for example. When operating in a cooling mode, the heat pump removes both sensible heat (reducing dry bulb temperature) and latent heat through condensation (reducing absolute humidity) from air in the conditioned space. When operating in a heating mode, the heat pump adds the sensible heat to the conditioned space (increasing the dry bulb temperature). The conditioned space may be one or more rooms within a building, for example.

Figure 1:
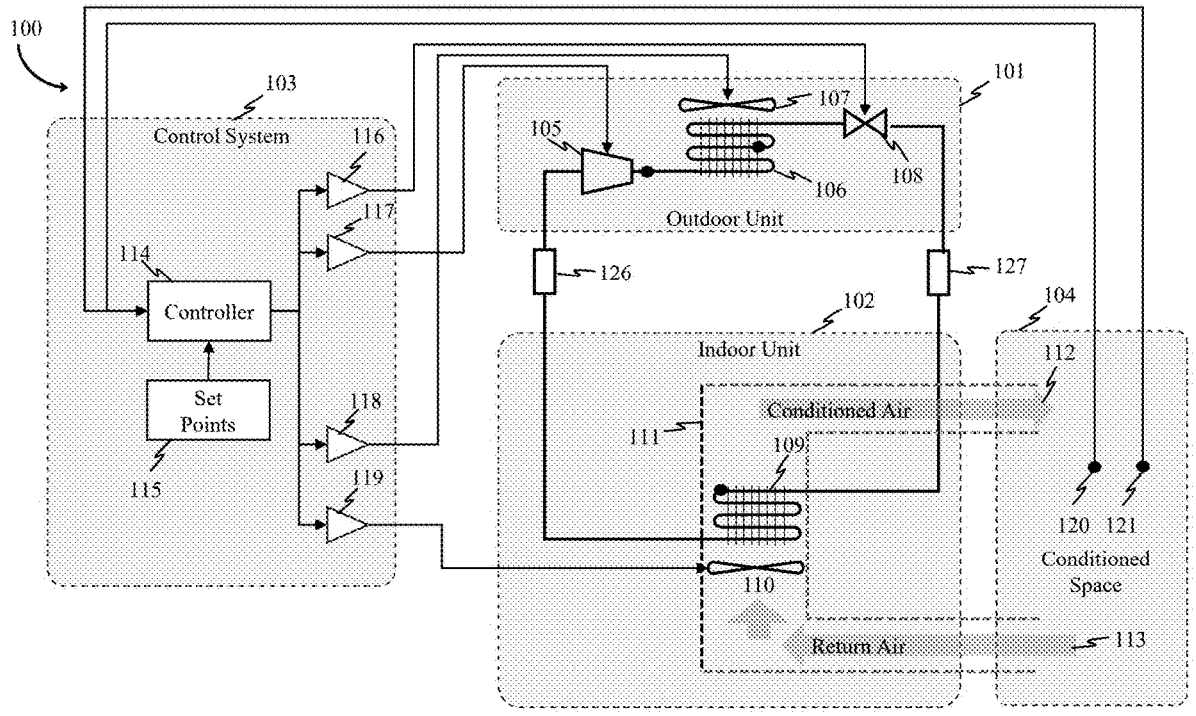
FIG. 1 illustrates an example heat pump, according to an embodiment of the present disclosure.

FIG. 1 illustrates an example heat pump 100, according to an embodiment of the present disclosure. The heat pump 100 includes an outdoor unit 101, an indoor unit 102, and a control system 103. The outdoor unit 101 includes a compressor 105, one or more outdoor heat exchanger coils 106, an outdoor fan 107, and an expansion device 108. The outdoor fan 107 may be a variable speed fan, and the compressor 105 may be a variable speed compressor. The expansion valve 108 may be electronically actuated, variable-orfice type commonly called an Electronic Expansion Valve (EEV). Further, the outdoor unit 101 includes additional components, including but not limited to receivers, accumulators, valves, pipes, or sensors. The outdoor unit 101 is connected by pipes 126 and 127 to the indoor unit 102.

The indoor unit 102 includes one or more indoor heat exchanger coils 109, a indoor fan 110, and a duct 111. The indoor fan 110 may be a variable speed fan or a fixed speed fan. The duct 111 may vent conditioned air 112 to a conditioned space 104. In some embodiments, the duct 111 is integrated around the indoor fan 110 and the one or more indoor heat exchanger coils 109, as a packaged unit. Further, the indoor unit 102 includes additional components, including but not limited to EEVs, receivers, accumulators, valves, pipes, or sensors.

The control system 103 includes a controller 114 configured to compute values for a set of controlled variables, which includes, but is not limited to, a speed of the compressor 105, a speed of the outdoor fan 107 and the indoor fan 110, or a setting of the EEV 108, and a heat pump mode, in order to regulate air temperature and relative humidity of the conditioned space 104, and possibly one or more process variables associated with the heat pump. The control system 103 also includes interface devices, such as 116, 117, 118 and 119, configured to take as input a value for a controlled variable and produce as output a command to a corresponding heat pump component. For example, the interface device 117 takes as input a value of compressor speed, and produces as output a set of signals appropriate to drive the compressor 105 at the value. The interface device 117 may be an electrical amplifier or inverter. The interface device 118 takes as input a value for an outdoor fan speed, and produces as output a set of signals appropriate to drive the outdoor fan speed at that value. The interface device 118 may be an electrical amplifier or inverter. The interface device 116 takes as input a value for EEV setting, and produces as output a set of signals appropriate to drive the EEV 108 to that setting. The interface device 116 may be a stepper motor driver, for example. The control system 103 also includes setpoints 115 which include a setpoint value such as temperature or relative humidity of the conditioned space, for example.

An energy efficiency of the heat pump may be measured using Coefficient of Performance (COP), which is defined as useful heat energy (or power) divided by applied input energy (or power). The input energy (or power) may be electrical, mechanical or chemical in nature, depending on a type of the heat pump. Energy efficiency ratings are defined using a weighted average of COPs, measured at one or more thermodynamic conditions. Rated energy efficiency of the heat pump may be improved through use of variable speed compressors, variable speed fans, or EEVs, which allow the heat pump to operate efficiently over a range of operating conditions.

Some embodiments are based on the recognition that, in some conditions, the heat pump provides poor latent heat performance, resulting in high levels of relative humidity in the conditioned space. For example, some heat pumps may be manufactured using one or more heat exchanger coils that are designed to improve energy efficiency ratings, but as a consequence have reduced latent heat capacity. In another example, some building construction codes have evolved to call for higher amounts of insulation and tighter construction, which reduce sensible heat load on heating or cooling equipment, and may also reduce outdoor air infiltration. However, even tight building construction can allow for 0.25 outdoor air changes per hour (ACH) by infiltration. In some humid climates, outdoor relative humidity can be nearly 100% overnight, and air infiltration can drive the conditioned space relative humidity above comfortable levels. In yet another example, the heat pump may be oversized for an application, resulting in on-off cycling that results in elevated indoor relative humidity levels. There may be other reasons for which the heat pump may provide poor latent heat performance.

Figure 2:
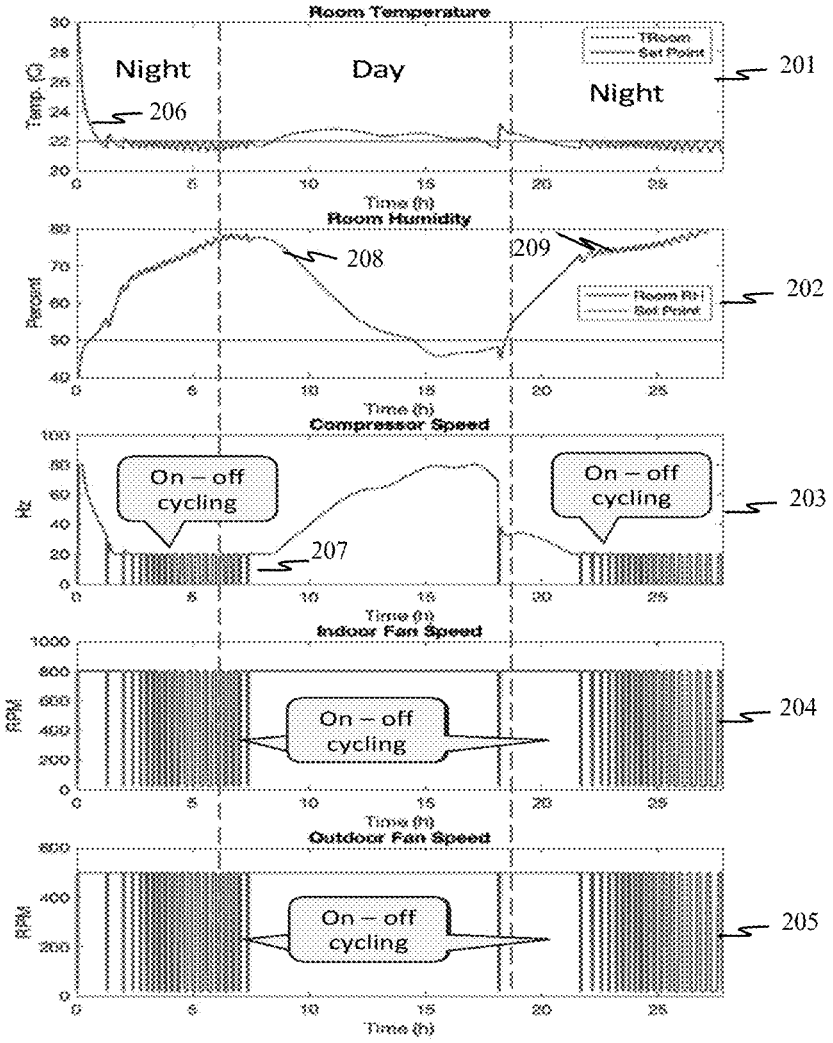
FIG. 2 illustrates a result of a computer simulation that illustrates a behavior of the heat pump.

FIG. 2 illustrates a result of a computer simulation that illustrates a behavior of the heat pump operating in a cooling mode, according to some embodiments. The heat pump includes an the indoor unit 102 of forced-air type. A simulation model of the heat pump was coupled to a model of a house constructed to meet modern building codes, for example, for Houston TX, US (representing a very humid climate zone) and used meteorological year (TMY) weather data for Houston. The simulation began at midnight following a hot summer day, and ran for 27 h, including overnight, the following (hot) day, and a second night. Initially, building constructions and indoor air were 30° C. and 40% relative humidity. FIG. 2 shows time series results for conditioned zone temperature and setpoint 201, a conditioned space relative humidity and setpoint 202, a compressor speed 203, an indoor fan speed 204 and an outdoor fan speed 205, respectively. The heat pump pulled down air temperature to 22° C. setpoint within an hour 206. Soon after, the compressor speed, driven by feedback, dropped to its minimum speed limit, and then the heat pump cycled on and off for remainder of night 207 because of a low sensible heat load. As a result, latent heat capacity of indoor heat exchanger was relatively low, and the indoor relative humidity increased overnight, until it reached 80% 208. Once sun rose the next day, the compressor speed increased due to an increased sensible heat load, as a result of feedback, and the relative humidity dropped, but it peaked above 80% second night 209. Although this particular simulation represents an extreme condition, high indoor relative humidity in humid climate zones, especially overnight, is a real problem.

As such, there is a need for the heat pump that regulates both the conditioned space temperature and the conditioned space relative humidity. Control of both the conditioned space (dry bulb) temperature, and the conditioned space relative humidity, is denoted simultaneous control of temperature and humidity. However, herein regulation of both conditioned space temperature and conditioned space relative humidity will be denoted simultaneous regulation of temperature and humidity, to avoid overloading the term "control" with too many meanings.

Some embodiments are based on the recognition that simultaneous regulation of the conditioned space temperature and relative humidity can be achieved, in the cooling mode, by modulating the compressor speed, CF, and the indoor fan speed, IFS, to regulate the conditioned space temperature $T_r$ and relative humidity $\phi_r$.

Figure 3:
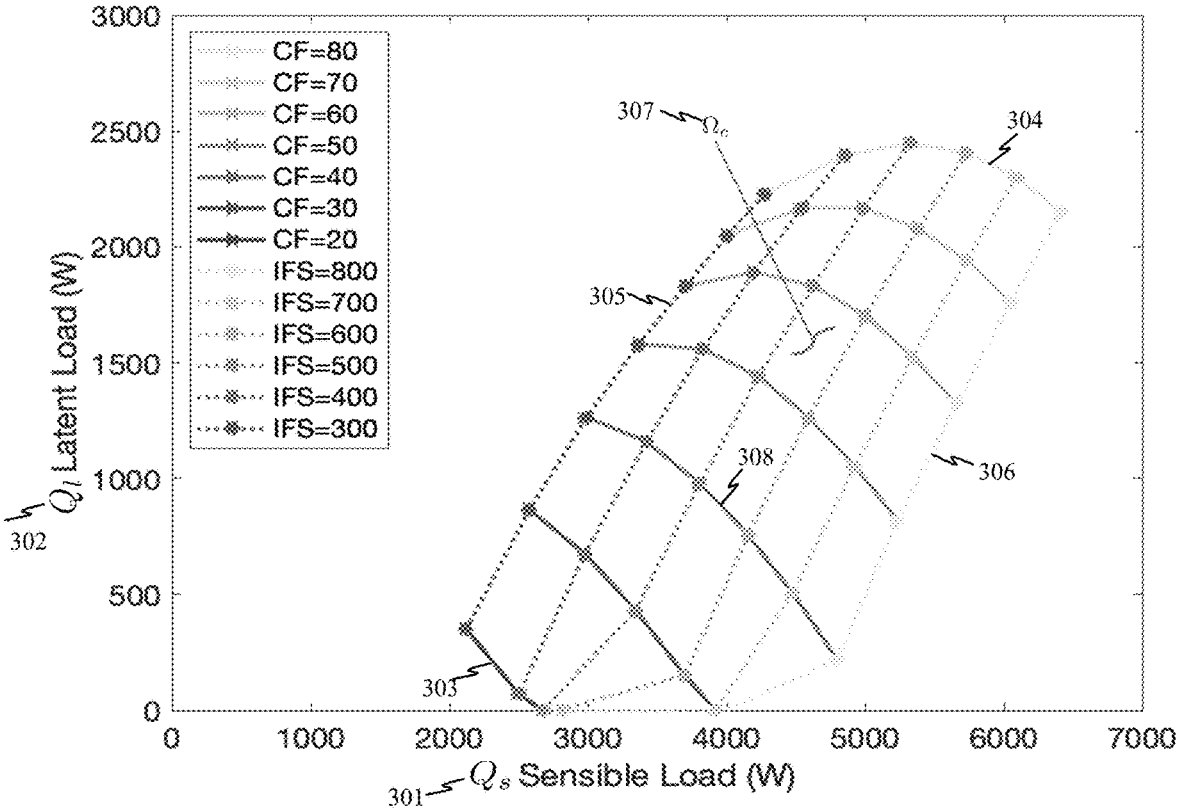
FIG. 3 illustrates a diagram of a range of sensible heat load and latent heat load that may be met by modulating a compressor speed (CF) and an indoor fan speed (IFS) in a cooling mode of operation, according to some example embodiments.

FIG. 3 illustrates a diagram of a range of sensible heat load $Q_s$ 301 and latent heat load $Q_l$ 302 that may be met by modulating the CF and the IFS, according to some example embodiments. The diagram is generated by repeated numerical simulation of a simulation model. For any pair of constant values for the sensible heat load $Q_s$ 301 and the latent heat load $Q_l$ 302 in a region $\Omega_c$ 307, there are corresponding values for the CF and the IFS to meet both heat loads and achieve a conditioned space air temperature setpoint $\overline{T}_r$=22° C. and a conditioned space relative humidity setpoint $\overline{\phi}_r$=50%, for example. If the heat pump meets a given constant sensible and latent heat load pair, ($Q_s$, $Q_l$), and achieve both the conditioned space air temperature setpoint $\overline{T}_r$ and conditioned space relative humidity setpoint $\overline{\phi}_r$, with small or zero steady-state error, then a constant heat load disturbance pair ($Q_s$, $Q_l$) is said to be rejected. The control system 103 includes a first feedback loop to modulate the CF to cause a measured conditioned space air temperature $T_r$ 120 to achieve the conditioned space temperature setpoint $\overline{T}_r$, and includes a second feedback loop to modulate the IFS to cause a measured conditioned space relative humidity $\phi_r$ 121 to achieve the conditioned space relative humidity setpoint $\overline{\phi}_r$, but other feedback architectures are possible.

Such an approach has several limitations. First, the range of sensible and latent heat loads that may be rejected, as indicated by $\Omega_c$ 307, for example, is limited. As FIG. 3 shows, there are no combinations of the CF or the IFS to reject values of the sensible heat load $Q_s$ less than a limit 305. In such a situation, the control system 103 may cause the conditioned space air temperature $T_r$ to achieve its setpoint $\overline{T}_r$, but may fail to cause the conditioned space relative humidity $\phi_r$ to achieve its setpoint $\overline{\phi}_r$. The heat pump operating in the cooling mode may shut off in this situation, resulting in a condition in which the air temperature of the conditioned space $T_r$ is at or below its setpoint $\overline{T}_r$, but the conditioned space relative humidity $\phi_r$ remains above its setpoint $\overline{\phi}_r$. This situation is referred to as overcooling.

Figure 4:
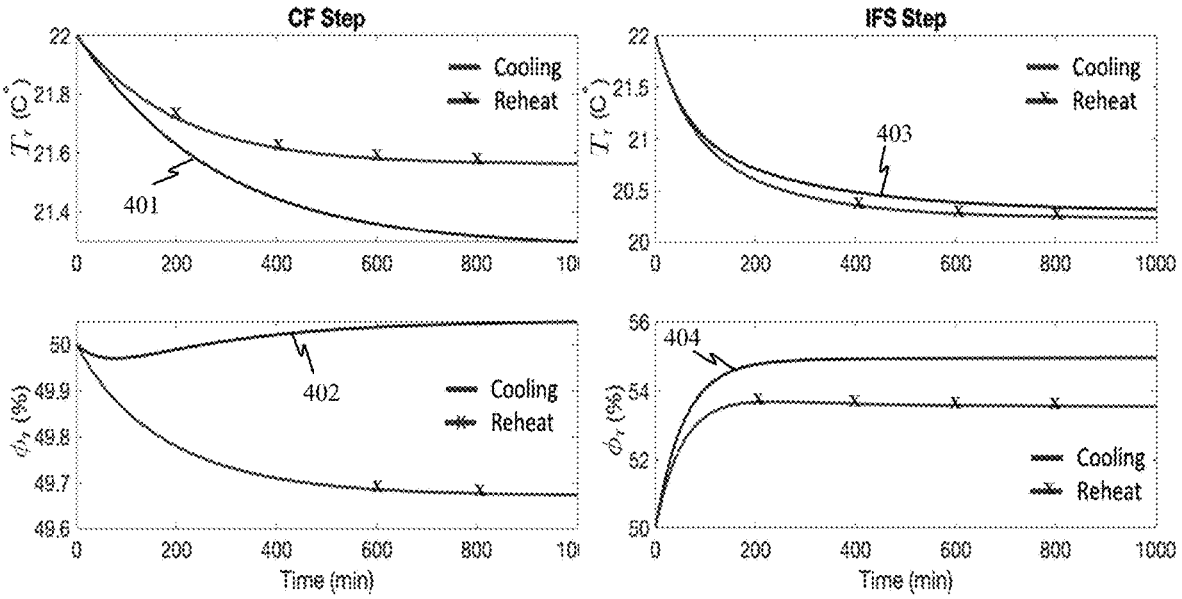
FIG. 4 shows a set of step responses from inputs CF and IFS to outputs conditioned space temperature ($T_r$) and conditioned space relative humidity ($\phi_r$) for the heat pump in a cooling mode, according to some embodiments.

FIG. 4 shows a set of step responses from inputs CF and IFS to outputs the conditioned space temperature $T_r$ and the conditioned space relative humidity $\phi_r$ for the heat pump in a cooling mode, according to some embodiments. When the CF is increased by 1 Hz, the conditioned space temperature $T_r$ decreases 401, but the conditioned space relative humidity $\phi_r$ increases 402, after initially decreasing. Such a behavior is referred to as a non-minimum phase response, and is caused by the psychrometrics of air. When moist air cools, it may hold less water and the relative humidity can increase, even though absolute humidity may decrease. A step input of 10 RPM from the IFS causes the conditioned space temperature $T_r$ to decrease 403, and to the relative humidity or to increase 404.

Thus, the control system 103 of the heat pump in a cooling mode may cause an overcooled state in which the conditioned space temperature $T_r$ may be driven to its setpoint or below its setpoint $\overline{T}_r$, while the relative humidity $\phi_r$ may remain above its setpoint $\overline{\phi}_r$, and the heat pump shuts off.

Figure 5:
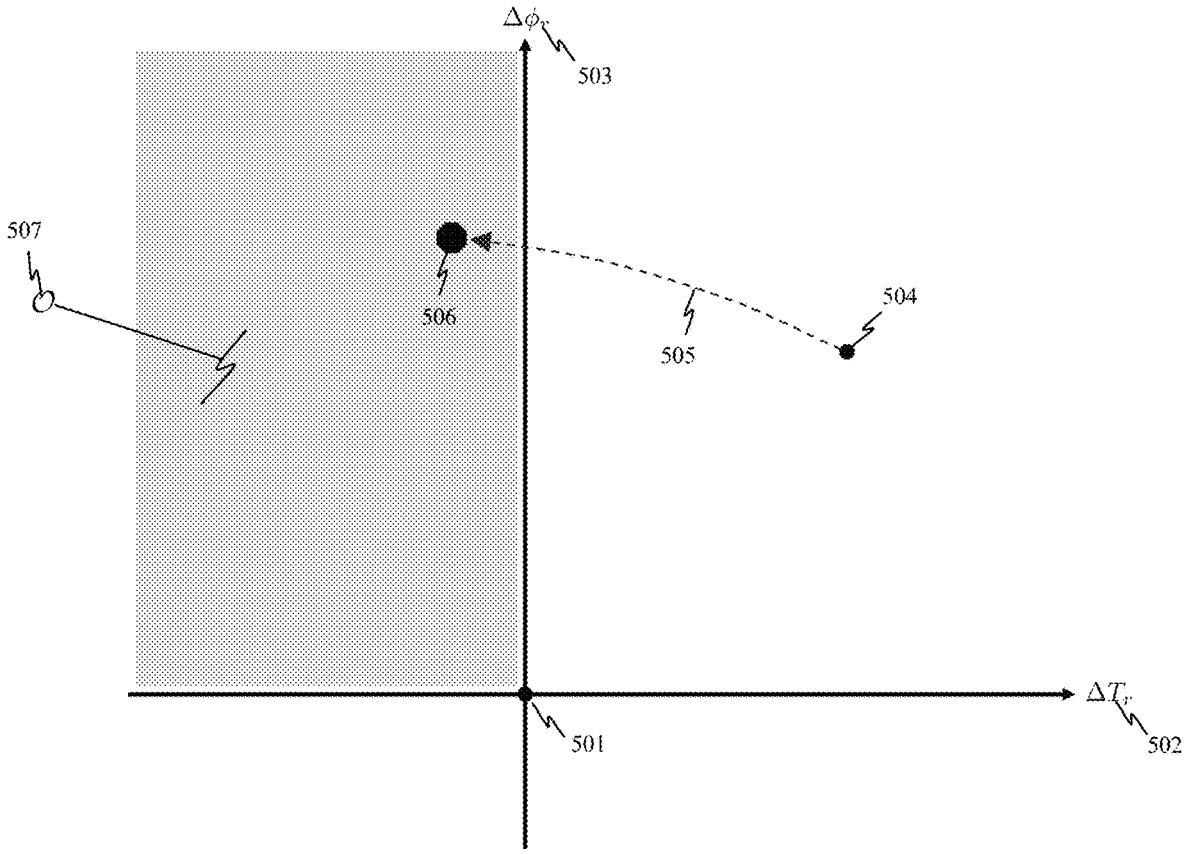
FIG. 5 illustrates a diagram that shows a representative trajectory in a set of coordinates ($\Delta T_r$, $\Delta\phi_r$) for the heat pump operating in a cooling mode, according to some embodiments.

FIG. 5 illustrates a diagram that shows a representative trajectory in a set of coordinates ($\Delta T_r$, $\Delta\phi_r$), where $\Delta T_r = T_r - \overline{T}_r$ and $\Delta\phi_r = \phi_r - \overline{\phi}_r$, according to some embodiments. The conditioned space temperature and relative humidity is initially 504, and in a cooling mode may follow path 505, resulting in a conditioned space temperature setpoint error $\Delta T_r < 0$ but a conditioned space relative humidity setpoint error $\Delta\phi_r > 0$. The heat pump then shuts off at an overcooled state 506, leaving the conditioned space in the overcooled state. The heat pump operating in a cooling mode cannot recover from the overcooled state to drive both $\Delta\phi_r$ and $\Delta T_r$ to a small or zero value, because the heat pump cannot add sensible heat to the conditioned air 112. A set of overcooled states 507 is denoted O.

A second limitation results from pairing of the CF to regulate the conditioned space temperature $T_r$, and the IFS to regulate the conditioned space relative humidity $\phi_r$. At high values of $\Delta\phi_r$, the IFS may be driven to a low speed. This causes more latent heat to be absorbed from the conditioned air 112. As shown in FIG. 3, lower values of the IFS such as IFS=300 RPM 305 may remove higher amounts of latent heat $Q_l$ 302 from the air, compared to higher values of the IFS such as IFS=800 RPM 306, for a given fixed value of the CF, especially for lower values of the CF. However, a lower value of the IFS reduces transfer of sensible heat through heat exchanger, as constant contours of CF show in FIG. 3, for example CF=40 Hz 308. In this situation, if the conditioned space temperature error $\Delta T_r$ is also large, then reduced sensible heat transfer through the heat exchanger, caused by the lower value of the IFS, is undesirable, because it may increase pull-down time which is a time to reduce $T_r$ to its setpoint $\overline{T}_r$, or it may even prevent $T_r$ from achieving $\overline{T}_r$.

Consequently, there is a need for the heat pump that can simultaneously regulate the temperature and relative humidity of the conditioned space, that is capable of rejecting a large range of sensible and latent heat loads, while also avoiding overcooling and on-off cycling, and also avoiding low fan speeds at high values of the conditioned space temperature and relative humidity setpoint error.

Some embodiments are based on the recognition that simultaneous control of the conditioned space temperature and humidity can be achieved across a broad range of sensible and latent heat loads by employing a condenser reheat heat exchanger in order to introduce supplemental sensible heat to the conditioned air 112. In this approach, a portion of the heat that would otherwise be discharged to an environment via the one or more outdoor heat exchanger coils 106 is introduced into the conditioned air 112 by one or more condenser reheat coils, located downstream (air wise) of the indoor heat exchanger coil 109, or located in parallel (air wise) to the indoor heat exchanger coil 109. The supplemental sensible heat causes the control system 103 to automatically increase the CF, in order to maintain the conditioned space air temperature setpoint. This causes refrigerant of the heat pump to evaporate at a lower temperature inside the indoor heat exchanger coil 109, which therefore condenses more water from the conditioned space, resulting in an increased latent heat capacity and lower conditioned space relative humidity. Further, in some embodiments, the condenser reheat coil is placed in parallel (refrigerant wise) with the outdoor heat exchanger coil. However, such an arrangement has a significant disadvantage that it requires three pipes to run between the indoor unit 102 and the outdoor unit 101, instead of two pipes 126 and 127.

Consequently, there is still a need for a control system for the heat pump that can simultaneously and automatically regulate the temperature and relative humidity of the conditioned space, that is capable of automatically rejecting a large range of sensible and latent heat loads, while also avoiding the overcooling and the on-off cycling, and also avoiding low fan speeds at high values of the conditioned space temperature and relative humidity setpoint error.

Solution Overview

It is an object of some embodiments to provide a control system for a heat pump that can simultaneously and automatically regulate the temperature and relative humidity of a conditioned space, that is capable of automatically rejecting a large range of sensible and latent heat loads, while also avoiding the overcooling and the on-off cycling, and also avoiding low fan speeds at high values of the conditioned space temperature and relative humidity setpoint error.

Figure 6:
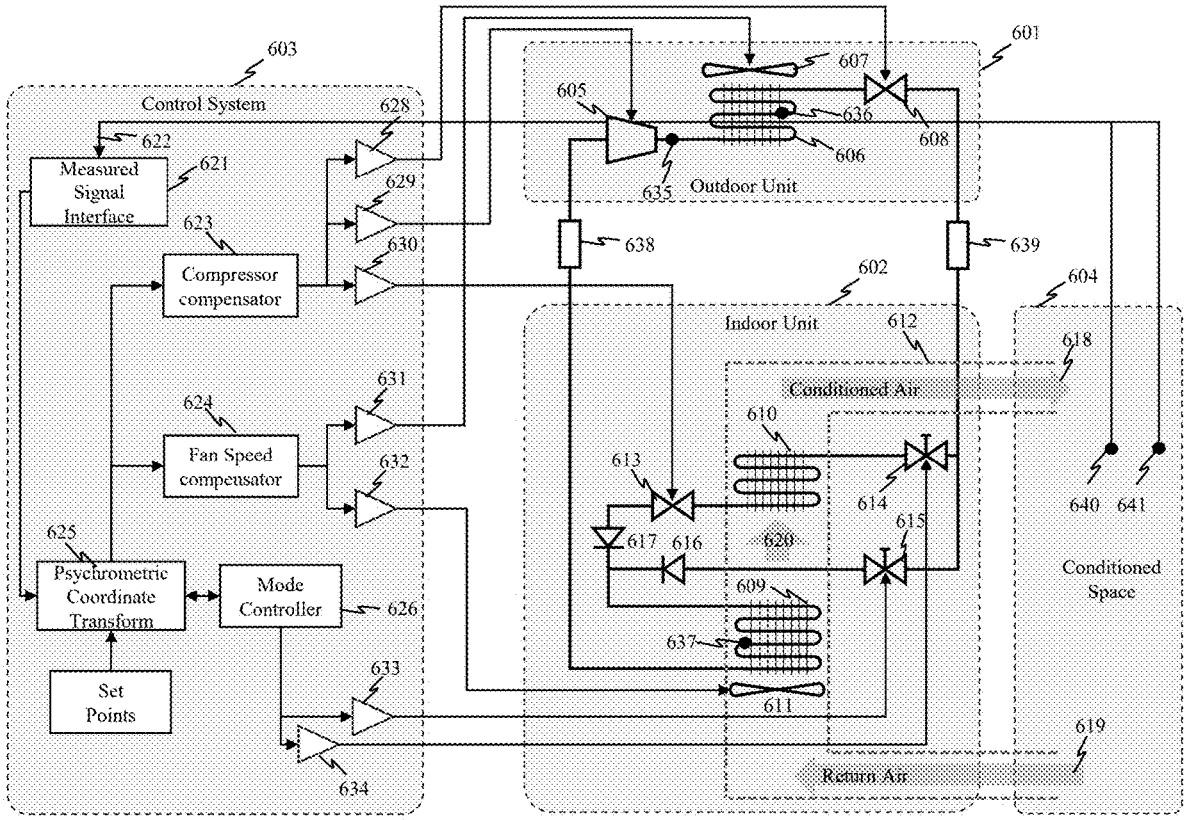
FIG. 6 illustrates a control system for controlling an operation of a vapor compression cycle of a multi mode heat pump, according to an embodiment of the present disclosure.

Such a control system 603 is illustrated in FIG. 6. The control system 603 is configured to control an operation of a vapor compression cycle of a heat pump. The heat pump includes an outdoor unit 601 connected to an indoor unit 602. One or more sensor measurement signals 622 are produced by one or more sensors including one or more conditioned space temperature sensors 640, one or more conditioned space humidity sensors 641, and may include one or more sensors associated with the heat pump such as a compressor discharge temperature sensor 635, a condenser temperature sensor 636, or an evaporator temperature sensor 637. Some sensors may directly measure a physical variable, such as the relative humidity. Some sensors may indirectly infer a physical variable via other means such as a correlation with a measurement. It is understood that the conditioned space temperature and relative humidity may be computed from measurements of other variables, such as dry and wet bulb temperatures, for example, and that an embodiment may make use of these types of sensors.

The heat pump may operate in a cooling mode, a reheat mode, or an off mode. There may be other modes as well. The vapor compression cycle for the cooling mode for an embodiment operates as follows. Refrigerant vapor is compressed by a compressor 605, raising its pressure and temperature. The refrigerant further flows into an outdoor heat exchanger coil 606, where it condenses into liquid, releasing heat to an outdoor environment. In the cooling mode, an EEV 608 (also referred to as outdoor expansion valve) is used as an expansion device. After passing through the outdoor heat exchanger coil 606, the refrigerant passes through the EEV 608, its pressure and temperature drop and it becomes cold, two-phase fluid. In some embodiments, the EEV 608 is located in the outdoor unit 601. In some other embodiments, the EEV 608 is located in the indoor unit 602. In yet some other embodiments, the EEV 608 is located between the outdoor unit 601 and the indoor unit 602. After passing through the EEV 608, the refrigerant passes through a pipe 639, a bypass valve 615, which is in an open state in the cooling mode, and into an indoor heat exchanger coil 609, after passing through a check valve 616, where it evaporates, absorbing heat from return air stream 619. Further, low pressure vapor is returned to the outdoor unit 601 via a pipe 638, closing the vapor compression cycle.

The vapor compression cycle for the reheat mode for an embodiment operates as follows. The EEV 608 is opened to its maximum value, or near its maximum value, so that its pressure (and temperature) drop is minimal. After partial expansion by the EEV 608, warm refrigerant passes through the pipe 639, a reheat valve 614, which is open for the reheat mode, and into a condenser reheat heat exchanger coil 610, where it heats conditioned air 618. It then passes through an indoor EEV 613 (also referred to as indoor expansion valve), which is used as the expansion device. As the refrigerant passes through the indoor EEV 613, its pressure and temperature drop and it becomes cold two-phase fluid, which passes through a check valve 617 and into the indoor heat exchanger coil 609, where it evaporates, absorbing heat from the return air stream 619. The low pressure vapor is returned to the outdoor unit 601 via the pipe 638, closing the vapor compression cycle. It is understood that a heat pump may include other components, including but not limited to check valves, receivers, accumulators or four way valves.

According to an embodiment, purpose of the reheat mode is to provide an increased latent heat capacity relative to the cooling mode, in order to remove excess humidity from conditioned air 612. This is achieved in two ways. First, when the reheat mode is operational, the refrigerant in the condenser reheat heat exchanger coil 610 is cooled by airstream 620 coming off the indoor heat exchanger coil 609, which is approximately, for example, 10-15° C. and usually colder than outdoor air. This results in a colder liquid refrigerant entering the indoor EEV 613, and therefore colder two-phase refrigerant entering the indoor heat exchanger coil 609, which therefore condenses more water, compared to the cooling mode. Second, because the condenser reheat heat exchanger coil 610 adds sensible heat to the conditioned air 618, the control system 603 may increase the compressor speed, in order to regulate the conditioned space air temperature to its setpoint, for example. As a result, the indoor heat exchanger coil 609 cools and condenses more water, compared to the cooling mode. Both of these effects combine to reduce a temperature of the indoor heat exchanger coil 609, and therefore increase an amount of latent heat removed from the return air stream 619, relative to the cooling mode.

Figure 7:
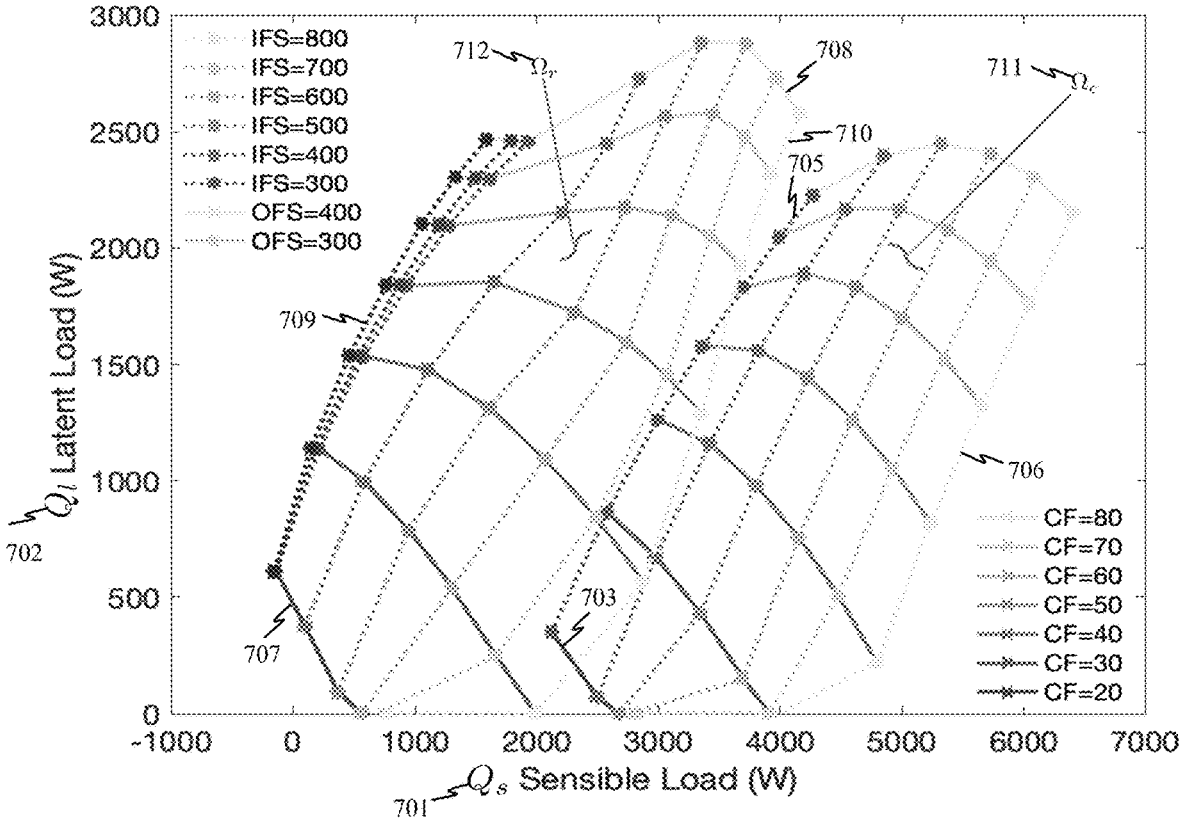
FIG. 7 shows a diagram illustrating a range of sensible heat load $Q_s$ and latent heat load $Q_l$ that may be rejected by modulating the CF, the IFS, and an outdoor fan speed (OFS), according to an embodiment the present disclosure.

FIG. 7 shows a diagram illustrating a range of sensible heat load $Q_s$ 701 and latent heat load $Q_l$ 702 that may be rejected by modulating the CF, the IFS, and an outdoor fan speed (OFS), according to an embodiment the present disclosure. The diagram is generated by repeated numerical simulation of a simulation model. For any pair of constant values for the sensible heat load $Q_s$ 701 and the latent heat load $Q_l$ 702 in a region $\Omega_c$, 711 or region $Q_r$ 712, there are corresponding values for the CF, the IFS, and the OFS to meet both heat loads and achieve the conditioned space air temperature setpoint $\overline{T}_r$=22° C. and conditioned space relative humidity setpoint $\overline{\phi}_r$=50%, for example. The region $\Omega_c$ 711 is for the cooling mode, and the region $\Omega_r$ 712 is for the reheat mode. By including the reheat mode, an effective area of ($Q_s$, $Q_l$) that may be rejected, $\Omega_c \cup \Omega_r$, is more than doubled, compared to the region $\Omega_c$ 307 for the cooling mode, for example.

Figure 8:
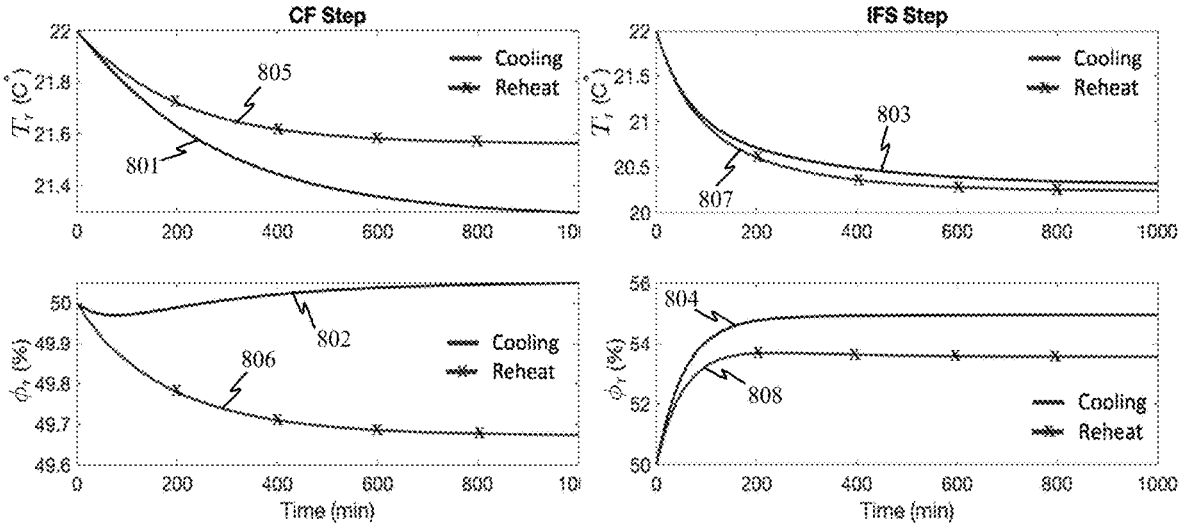
FIG. 8 shows a set of step responses from inputs CF and IFS to outputs the conditioned space temperature $T_r$ and the conditioned space relative humidity $\phi_r$ for the heat pump in a cooling mode and a reheat mode, according to some embodiments of the present disclosure.

FIG. 8 shows a set of step responses from inputs CF and IFS to outputs the conditioned space temperature $T_r$ and the conditioned space relative humidity $\phi_r$ for the heat pump in the cooling mode and the reheat mode, according to some embodiments. Some embodiments are based on the realization that in a cooling mode, an increase in a value of the CF results in a decrease in the conditioned space temperature $T_r$ 801, but may result in an increase in the conditioned space relative humidity $\phi_r$ 802. Similarly, some embodiments are based on the realization that in a cooling mode, an increase in a value of the IFS, results in a decrease in the conditioned space temperature $T_r$ 803, and also in an increase in the conditioned space relative humidity $\phi_r$ 804. Some embodiments are based on the realization that in a reheat mode, an increase in the value of the CF results in a decrease in the conditioned space temperature $T_r$ 805, and also a decrease in the conditioned space relative humidity $\phi_r$ 806. Furthermore, some embodiments are based on the realization that in a reheat mode, an increase in the value of the IFS results in a decrease in the conditioned space temperature $T_r$ 807, and also an increase in the conditioned space relative humidity $\phi_r$ 808.

Figure 9:
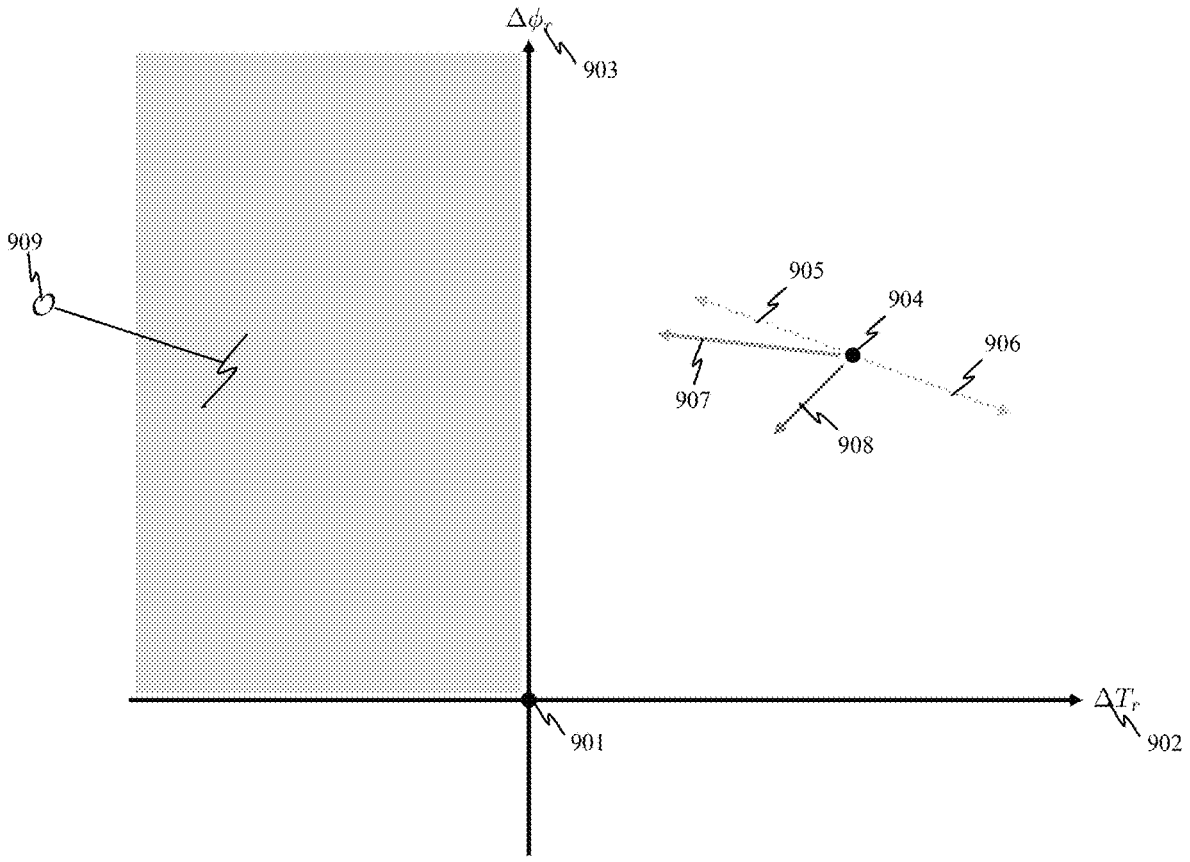
FIG. 9 illustrates directions of various vectors plotted on a ($\Delta T_r$, $\Delta\phi_r$)-plane, according to some embodiments of the present disclosure.

These realizations are diagrammed on a ($\Delta T_r$, $\Delta\phi_r$)-plane, as shown in FIG. 9, to make clear an effect on a conditioned space temperature and relative humidity 904 of increasing CF 907, increasing IFS 905, and decreasing IFS 906, in the cooling mode. Further, these realizations may be diagrammed on the ($\Delta T_r$, $\Delta\phi_r$)-plane to make clear an effect on the conditioned space temperature and relative humidity 904 of increasing CF 908, increasing IFS 905, and decreasing IFS 906, in the reheat mode. Directions of vectors 905, 906, 907 and 908 are computed from a simulation model of the heat pump operating in the cooling mode or the reheat mode, and are exemplary in nature. Precise directions will depend on specifics of the heat pump and application, and thermodynamic conditions. Nevertheless, FIG. 9 is representative of a general situation.

Some embodiments are based on the realization that the directions of vectors 905, 906, 907, and 908, are not all well-aligned with $\Delta T_r$ 902 direction, or $\Delta\phi_r$ 903 direction. Furthermore, use of ($\Delta T_r$, $\Delta\phi_r$) as feedback variables to control the CF and the IFS may result in an overcooled state 506, if only the cooling mode is used, and switch to a reheat mode must be made prior to reaching the overcooled state 506. Some embodiments are based on the realization that the IFS can be used to prevent the overcooled state 506, because of the direction 906. Some embodiments are based on the further realization that the OFS can also be used to prevent the overcooled state 506, because it also affects the heat pump in a manner similar to the vectors 905, 906, when the IFS is at a low setting, and the heat pump is operating in a reheat mode.

Some embodiments are based on the realization that psychrometric variables ($\sigma$, $\rho$) can be computed and defined to be better aligned with the directions of the aforesaid vectors, compared to ($\Delta T_r$, $\Delta\phi_r$). The psychrometric variables ($\sigma$, $\rho$) are computed by a psychrometric coordinate transformation $$(\sigma, \rho) = P(T_r, \bar{T}_r, \phi_r, \bar{\phi}_r) \quad (1)$$

where the psychrometric coordinate transformation P: $R^4 \rightarrow R^2$ is mathematically one-to-one and onto from $(T_r, \phi_r)$ to $(\sigma, \rho)$, (in order to ensure P defines a well-defined, singularity-free coordinate transformation), and satisfies a)

$$P(T_r, T_r, \phi_r, \phi_r) = (0, 0) \quad (2)$$

and b)

$$(\sigma(T_2, \phi_1) - \sigma(T_1, \phi_1)) \cdot (\sigma(T_1, \phi_2) - \sigma(T_1, \phi_1)) > 0 \quad (3)$$

and c)

$$(\rho(T_2, \phi_1) - \rho(T_1, \phi_1)) \cdot (\rho(T_1, \phi_2) - \sigma(T_1, \phi_1)) < 0, \quad (4)$$

for all conditioned space temperature values $T_1$ and $T_2$ satisfying $T_1 < T_2$ and all conditioned space relative humidity values $\phi_1$ and $\phi_2$ satisfying $\phi_1 < \phi_2$, in an operating range U, used in a feedback configuration, results in a smaller overcooled region, $O_p$, contained in U, compared to an overcooled region O obtained by using variables $(\Delta T_r, \Delta\phi_r)$.

Equations (2), (3) and (4) are used to compute the psychrometric variables $(\sigma, \rho)$ as a function of $T_r$, $\bar{T}_r$, $\phi_r$ and $\bar{\phi}_r$ via the psychrometric coordinate transformation P. Equations (3) and (4) mean that, for given values of setpoint temperature $\bar{T}_r$ and setpoint relative humidity $\bar{\phi}_r$, either 1. $\sigma$ increases when $T_r$ increases and $\sigma$ increases when $\phi_r$ increases, and $\rho$ increases when $T_r$ increases and $\rho$ decreases when $\phi_r$ increases, or
2. $\sigma$ decreases when $T_r$ increases and $\sigma$ decreases when $\phi_r$ increases, and $\rho$ decreases when $T_r$ increases and $\rho$ increases when $\phi_r$ increases.

Any variables $(\sigma, \rho)$ that satisfy one of these two conditions are denoted as the psychrometric variables. The psychrometric variables also satisfy $\rho=0$ and $\sigma=0$ when $T_r=\bar{T}_r$ and $\phi_r=\bar{\phi}_r$, which is implied by equation (2).

As such, some embodiments are based on the realization psychrometric variables $(\sigma, \rho)$, produced by the psychrometric coordinate transformation $(\sigma, \rho)=P(T_r, \bar{T}_r, \phi_r, \bar{\phi}_r)$ which satisfies (2)-(4), may be defined to be better aligned with the directions of vectors 905, 906, 907 and 908, compared to $(\Delta T_r, \Delta\phi_r)$. Further, some embodiments are based on the realization that the psychrometric variables $(\sigma, \rho)$ can be defined in a manner that allows for a feedback configuration wherein a first psychrometric variable $\sigma$ may be used to control the CF and the EEV 608, and a second psychrometric variable $\rho$, may be used to control the IFS and the OFS, and that such a configuration results in a feedback controller that actively avoids the overcooled state, achieves simultaneous regulation of the conditioned space temperature and relative humidity, and defines a switching logic among the cooling mode, the reheat mode, or the off mode. Furthermore, some embodiments are based on the realization that psychrometric variables can be used to redefine an overcooled region to be a smaller region of U, herein denoted $O_p$. This realization allows for the heat pump to continue to operate in the reheat mode for some conditions in which $\Delta T_r<0$ but $\Delta\phi_r>0$, and ultimately drive the conditioned space temperature and the conditioned space relative humidity to values at or near their setpoints.

Figure 10:
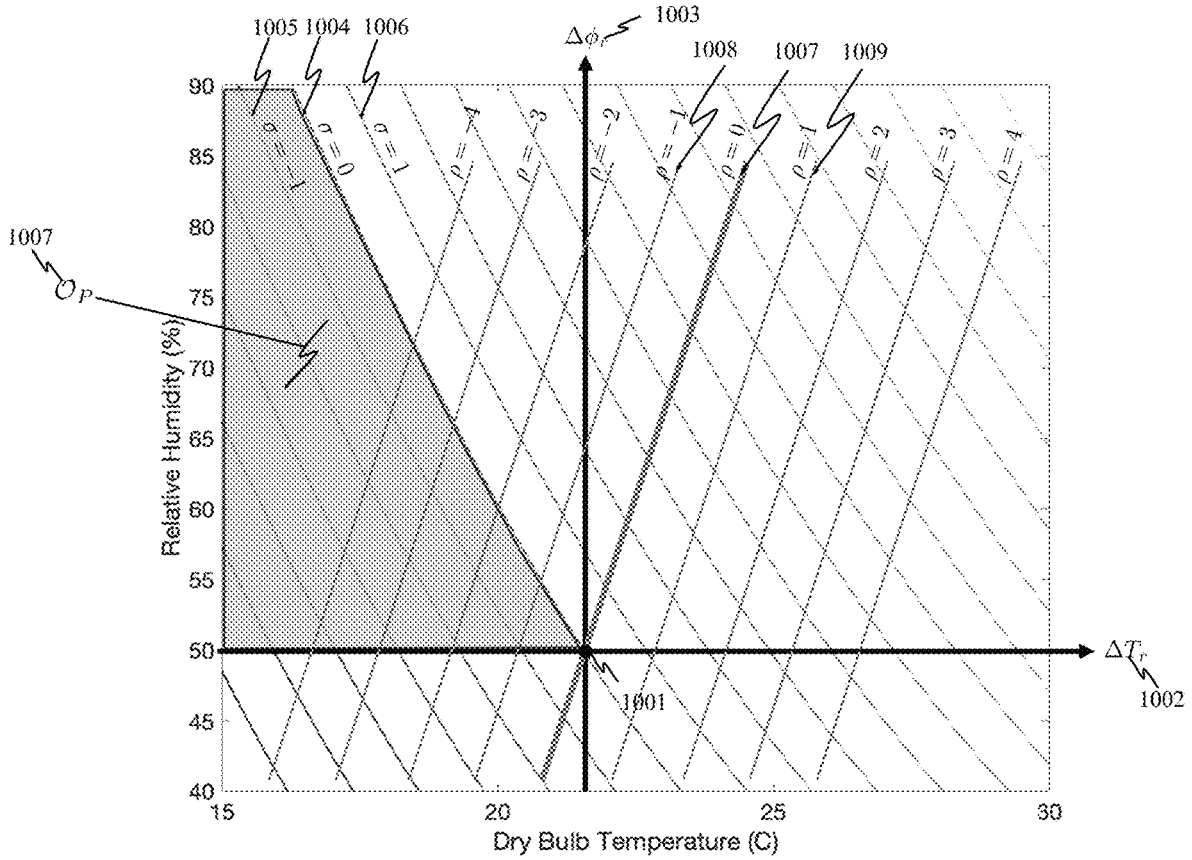
FIG. 10 illustrates psychrometric variables ($\sigma$, $\rho$), plotted on the ($\Delta T_r$, $\Delta\phi_r$)-plane, according to some embodiments of the present disclosure.

FIG. 10 illustrates an embodiment of the psychrometric variables $(\sigma, \rho)$ plotted on the $(\Delta T_r, \Delta\phi_r)$-plane in which a horizontal axis corresponds to a conditioned space temperature setpoint error $\Delta T_r$ 1002 and a vertical axis corresponds to a conditioned space relative humidity setpoint error $\Delta\phi_r$ 1003, according to some embodiments of the present disclosure. Origin of the $(\Delta T_r, \Delta\phi_r)$-plane is defined by a setpoint $(\bar{T}_r, \bar{\phi}_r)$ 1001. Constant contours of $\sigma$ are indicated, with contour $\sigma=0$ 1004 passing through the origin, contour $\sigma=-1$ 1005 to its left, and contour $\sigma=1$ 1006 to its right. Also shown are constant contours of $\rho$, with contour $\rho=0$ 1007 passing through the origin, contour $\rho=-1$ 1008 to its left, and contour $\rho=-1$ 1009 to its right. In this embodiment, the psychrometric variables, $\sigma$ is defined to be a difference between a wet bulb temperature of the conditioned space, and a wet bulb temperature corresponding to the setpoints $(\bar{T}_r, \bar{\phi}_r)$, $$\sigma = f_{wb}(T_r, \phi_r) - f_{wb}(\bar{T}_r, \bar{\phi}_r), \quad (5)$$

where a function $f_{wb}$ defines the wet bulb temperature as a function of dry bulb temperature (° C.) and relative humidity (%), may be defined as a)

$$T_{wb} = f_{wb}(T_r, \phi_r) \quad (6)$$

b)

$$= 273.15 + T_r \cdot \arctan(0.152 * \sqrt{\phi_r + 8.31})$$

c)

$$+\arctan(T_r + \phi_r) - \arctan(\phi_r - 1.68)$$

d)

$$+0.00391 \cdot \phi_r^{1.5} \cdot \arctan(0.021 \cdot \phi_r) - 4.686.$$

Other embodiments may use other functions to define o. In the embodiment diagrammed in FIG. 11, $\rho$ is defined as $$\rho = (T_r - \bar{T}_r) - \alpha \cdot (\phi - \bar{\phi}) \quad (7)$$

with $\alpha=10$. Other embodiments may use other functions to define $\rho$.

Some embodiments are based on the realization that the psychrometric variables $(\sigma, \rho)$ can be used to define an overcooled region $O_p$ 1007 to be a region of the $(\Delta T_r, \Delta\phi_r)$-plane for which $\sigma<0$ and $\Delta\phi_r>0$, and that the area of this region may be smaller than O defined using $\Delta T_r<0$ and $\Delta\phi_r>0$. Therefore, the heat pump can be operated over a larger region of the $(\Delta T_r, \Delta\phi_r)$-plane, and avoid overcooling. This is possible because the heat pump operating in the reheat mode removes a lower amount of sensible heat while also removing latent heat from the conditioned space.

Some embodiments are based on the realization that the psychrometric variables $(\sigma, \rho)$ in a feedback configuration improves decoupling between the directions corresponding to the CF and both IFS and OFS. In the reheat mode, the CF direction is well aligned with $\sigma$, but has little affect on $\rho$, while both the IFS and the OFS are well aligned with ρ, but have little affect upon σ. In the cooling mode, the CF direction is well aligned with ρ. Some embodiments are based on the realization that the psychrometric variables (σ, ρ), used in the feedback configuration, allows the IFS and the OFS to be used to prevent overcooling at high values of $\Delta\phi_r$.

Some embodiments are based on the realization that the OFS is effective increasing the range of sensible and latent heat loads ($Q_s$, $Q_l$) that may be rejected, particularly at values of low IFS. This is apparent in FIG. 7, where the range of low values of $Q_s$ can be extended by reducing the OFS at a minimum value of the IFS 709. Therefore, some embodiments are based on the realization that both the IFS and OFS can be used to simultaneously regulate the conditioned space temperature and relative humidity, by using the IFS until it reaches a minimum constraint, and then using the OFS, where it is effective. Some embodiments are based on the realization that the IFS has a minimum value that is constrained by other requirements, such as ventilation, for example, in the conditioned space.

As such, some embodiments employ two feedback loops, namely, a first feedback loop and a second feedback loop. The first feedback loop is defined to include a psychrometric coordinate transform P 625, which produces as output the first psychrometric variable σ, which is used as input to a compensator 623, which produces a value for the CF. The compressor compensator 623 may also provide a value for one or more EEVs, in order to regulate a process variable associated with the heat pump, such as evaporator super heat $T_s$-$T_e$ or a compressor discharge temperature $T_d$. The first feedback loop causes σ to converge to 0 or nearly 0, or it may cause $\Delta T_r$ to converge to 0 or nearly 0. In some embodiments, the compressor compensator 623 produces a value for the EEV 608 in the cooling mode. In some embodiments, the compressor compensator 623 produces a value for the EEV 613 in the reheat mode. In some embodiments, the compressor compensator 623 produces a value for the EEV 608 that is at or near a maximum value.

The second feedback loop is defined to include the psychrometric coordinate transform P 625, which produces the second Psychrometric variable ρ, which is used as input to a fan speed compensator 624. The fan speed compensator 624 produces a value for the IFS and the OFS. The second feedback loop causes the second psychrometric variable ρ to converge to 0 or nearly 0. The fan speed compensator 624 produces a small value for the IFS or the OFS when ρ<0, in order to avoid the overcooled region $O_p$. The fan speed compensator 624 may produce a large value for the IFS or the OFS when ρ>0, in order to avoid a low value of the IFS when both $\Delta T_r>0$ and $\Delta\phi_r>0$.

In some embodiments, the fan speed compensator 624 produces values for the IFS and the OFS in a prioritized manner, such that the IFS and the OFS remain within a respective range of allowable values. Further, the fan speed compensator 624 may produce values of the IFS and the OFS such that the IFS is prioritized over the OFS, such that the IFS is computed as a function of the second psychrometric variable ρ while the IFS remains within the range of allowable values, and the OFS is kept at a constant value, but if the IFS is at or near a minimum value, then the OFS is computed as a function of a second Psychrometric variable ρ. In some embodiments, the fan speed compensator 624 may produce values of the IFS and the OFS as a function of the second psychrometric variable ρ.

The values for the EEV 608, the CF, and the EEV 613 produced by the compressor compensator 623 are input to interface devices 628-630, respectively, each of which produces an output to the corresponding heat pump component, in a manner that the input value is achieved by the heat pump component.

The values of the OFS and the IFS produced by the fan speed compensator 624 are input to interface devices 631 and 632 respectively, each of which produces an output to the corresponding heat pump component, in a manner that the input value is achieved by the heat pump component.

Figure 11:
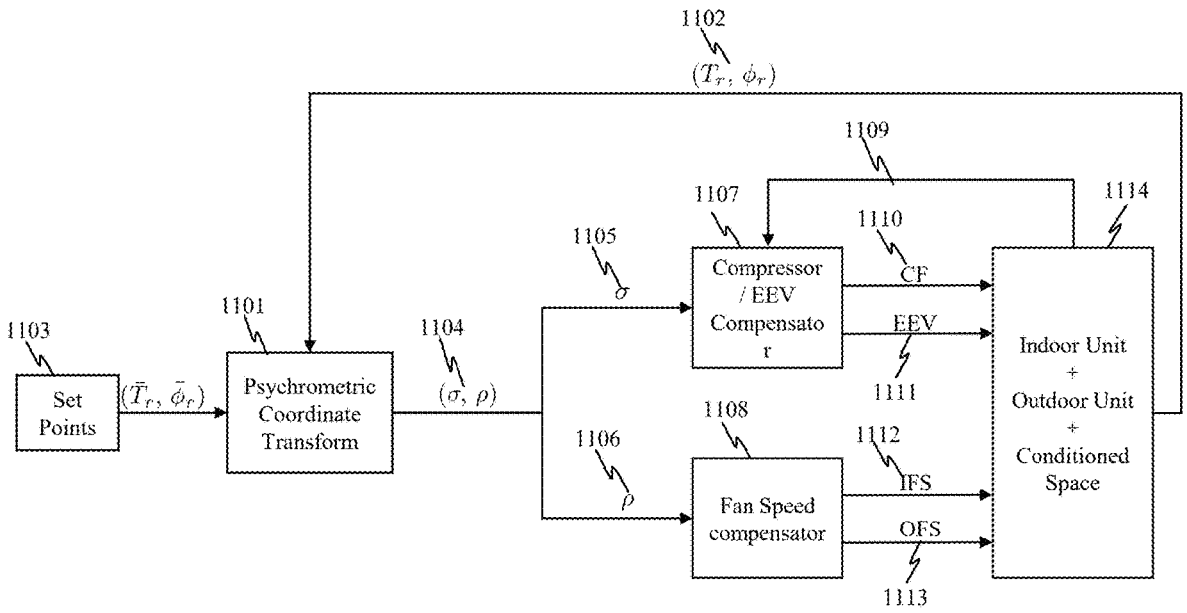
FIG. 11 shows a block diagram illustrating a first feedback loop and a second feedback loop including a psychrometric coordinate transform, according to some embodiments of the present disclosure.

FIG. 11 shows a block diagram illustrating the first and the second feedback loops including a psychrometric coordinate transform 1101, according to some embodiments of the present disclosure. The psychrometric coordinate transform 1101 produces values of psychrometric variables (σ, ρ) 1104 based on setpoints 1103. A first psychrometric variable σ 1105 is an input to a compressor compensator 1107, which produces values for a compressor speed CF 1110 and EEVs 1111. The second psychrometric variable ρ 1106 is an input to a fan speed compensator 1108, which produces values for an IFS 1112 and an OFS 1113. An indoor unit and an outdoor unit and a conditioned space 1114 produce measurements 1102 and 1109 to close the first and second feedback loops.

Figure 12:
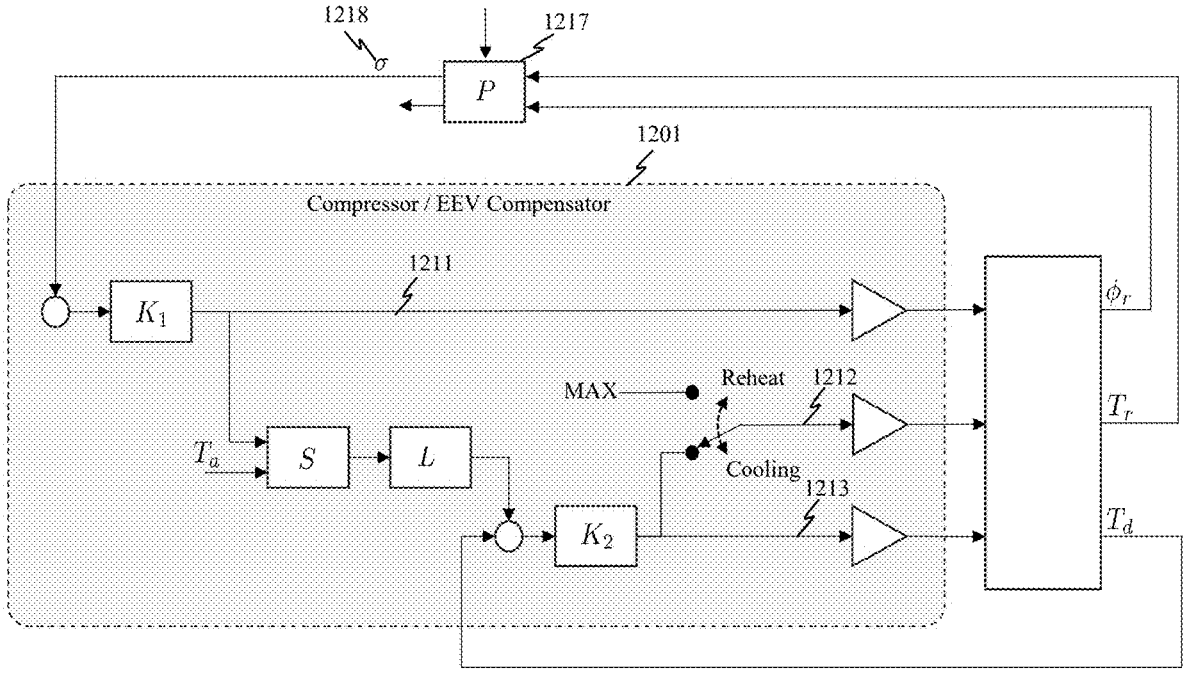
FIG. 12 shows a block diagram illustrating the first feedback loop including the psychrometric coordinate transform, according to some embodiments of the present disclosure.

FIG. 12 is a block diagram of an embodiment of a first feedback loop including a psychrometric coordinate transform 1217, according to an embodiment of the present disclosure. The psychrometric coordinate transform 1217 produces a first Psychrometric variable σ 1218, which is used as input to a compressor/EEV compensator 1201, which produces values for a compressor speed 1211, an outdoor EEV 1212 and an indoor EEV 1213.

Figure 13:
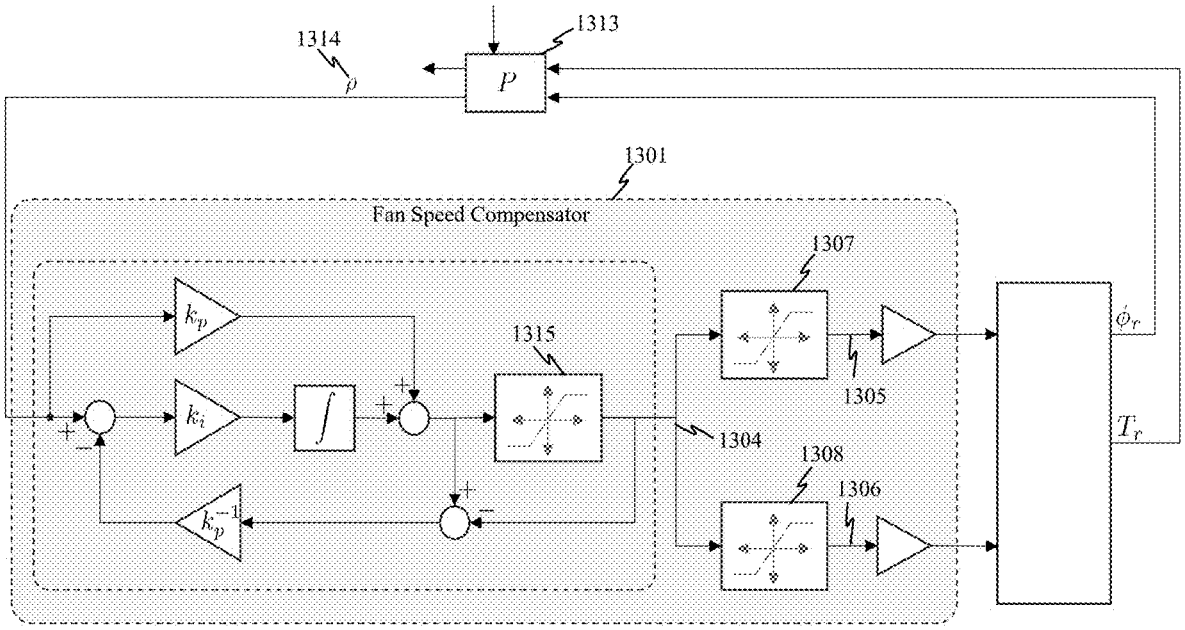
FIG. 13 shows a block diagram illustrating the second feedback loop including the psychrometric coordinate transform, according to some embodiments of the present disclosure.

FIG. 13 is a block diagram illustrating a second feedback loop including a psychrometric coordinate transform 1313, according to an embodiment of the present disclosure. The psychrometric coordinate transform 1313 produces a second Psychrometric variable ρ 1314, which is input to a fan speed compensator 1301, which produces values for an IFS 1305 and an OFS 1306. The fan speed compensator 1301 uses a Proportional-Integral compensator with anti-windup (PIaw) and limiter 1315, which has a minimum value corresponding to the minimum IFS plus the minimum OFS, and a maximum value corresponding to the maximum IFS plus the maximum OFS. The limited PIaw compensator produces an output 1304 which is split into two limiters 1307 and 1308, which provide values for the IFS and the OFS, respectively, in a prioritized manner such that the IFS is used in a range of operation while the OFS is kept at its maximum, but if the IFS is reduced to its minimum, then the OFS is actuated within its range of operation. Such a configuration allows for a priority of using the indoor fan first, but if it is reduced to its minimum then the outdoor fan speed is used.

Figure 14:
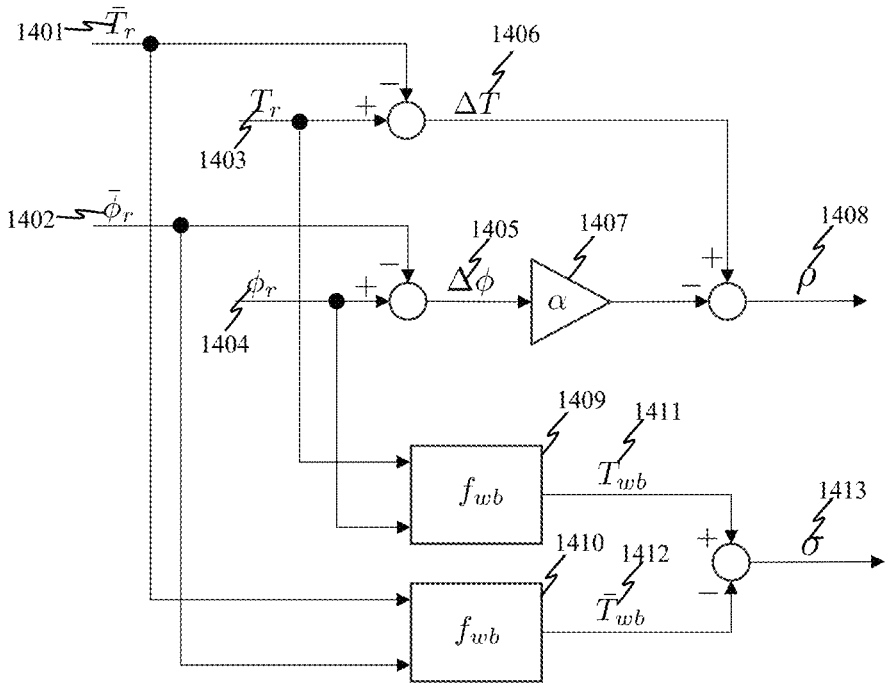
FIG. 14 shows a block diagram illustrating the psychrometric coordinate transform, according to an embodiment of the present disclosure.

FIG. 14 shows a block diagram illustrating the psychrometric coordinate transform, according to an embodiment of the present disclosure. The psychrometric coordinate transform takes as input a setpoint for conditioned space temperature $\overline{T}_r$ 1401, a setpoint for conditioned space relative humidity $\overline{\phi}_r$ 1402, a measured conditioned space temperature $T_r$ 1403 and a measured conditioned space relative humidity $\phi_r$ 1404, and produces values for a first psychrometric variable σ 1413 and a second psychrometric variable ρ 1408. In this embodiment of the psychrometric coordinate transform, a wet bulb temperatures $T_{wb}$ 1411 and $\overline{T}_{wb}$ 1412 are used to define σ 1413 using a function ($f_{wb}$) in blocks 1409 and 1410, and ρ 1408 is computed based on $\Delta T_r$ 1406, $\Delta\phi_r$ 1405, and a positive constant α 1407 using (7).

Some embodiments are based on the realization that changes among the cooling mode, the reheat mode, and the off mode can be automated by logic, defined with the psychrometric variables ($\sigma$, $\rho$).

Figure 15:
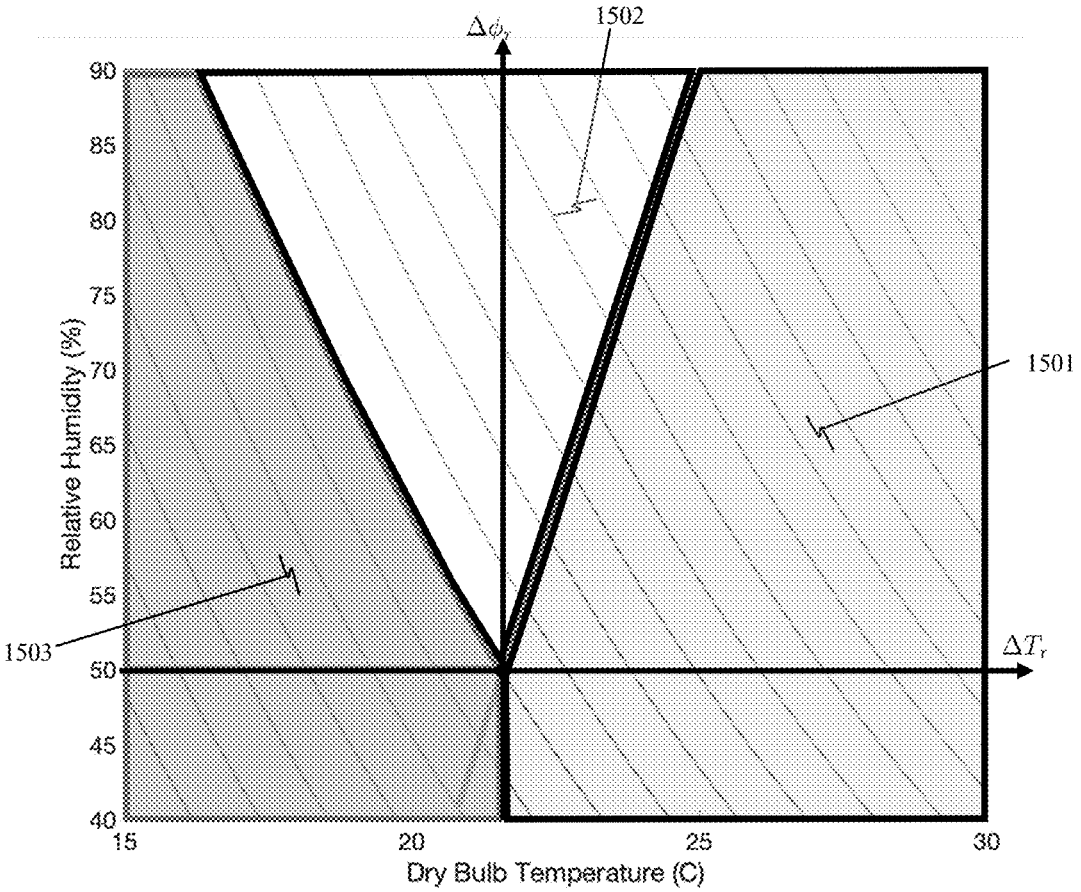
FIG. 15 illustrates switching among the cooling mode, the reheat mode, and an off mode of the heat pump, according to an embodiment of the present disclosure.

FIG. 15 illustrates switching among the cooling mode, the reheat mode, and the off mode, according to an embodiment of the present disclosure. The cooling mode to be operational when $\rho>0$ and $\Delta T_r>0$ 1501, the reheat mode to be operational when $p<0$ and $\sigma>0$ 1502, and otherwise the off mode to be operational 1503. Some embodiments may incorporate hysteresis into these switching logical statements, to prevent cycling or rapid switching between the modes. Some embodiments may incorporate timing constraints or limits into the switching logical statements, to maintain operation in a mode for a period of time, for example. Based on such switching logical statements, a mode controller 626 produces a value representing the heat pump mode of operation and produces values for mode-setting valves 614, 615. The values for the mode-setting valves 614, 615 are input to interface devices 633 and 634, respectively, each of which produces an output to the corresponding heat pump component, in a manner that the input value is achieved by the heat pump component.

Figure 16:
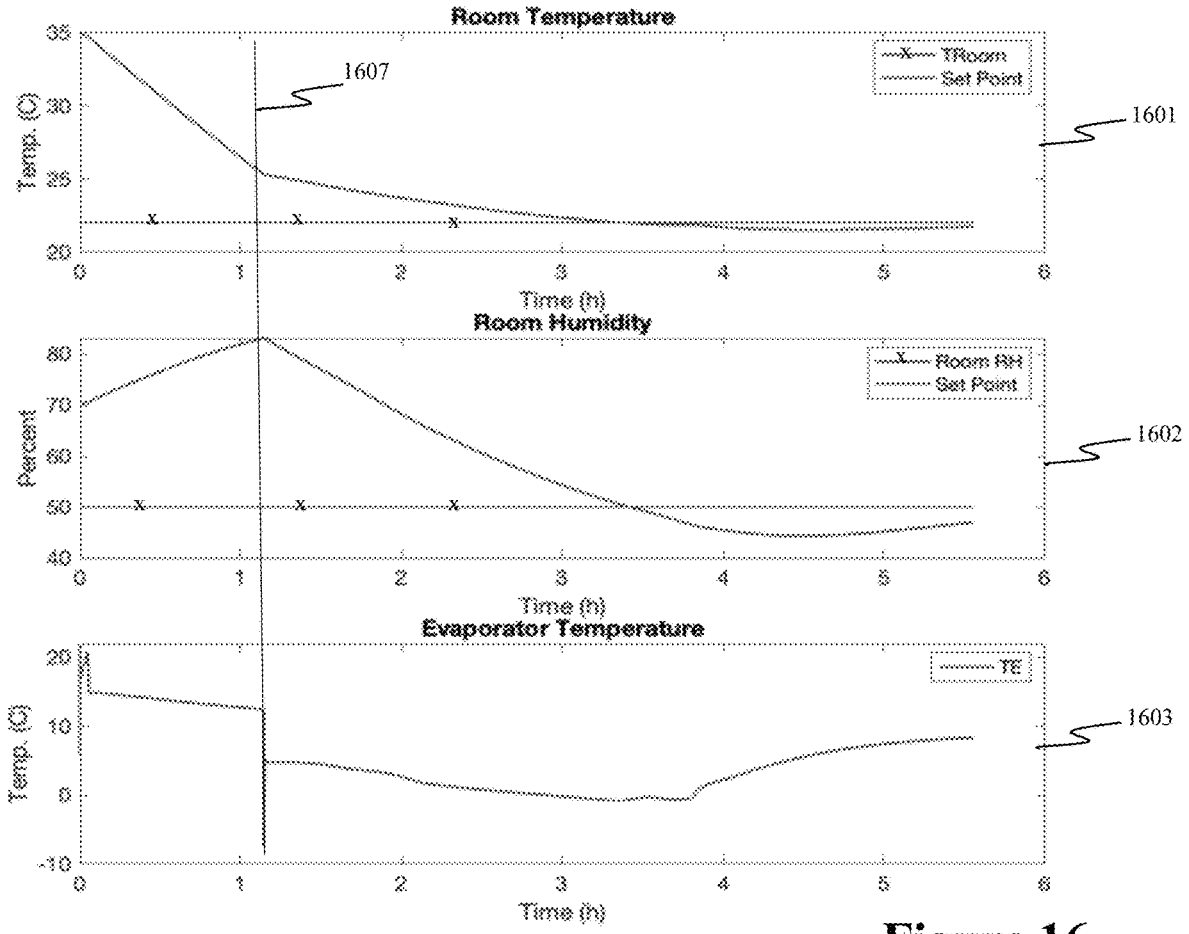
FIG. 16 shows result of a computer simulation of a multi-mode heat pump model that is connected to an adiabatic room model, according to an embodiment of the present disclosure.
Figure 16:
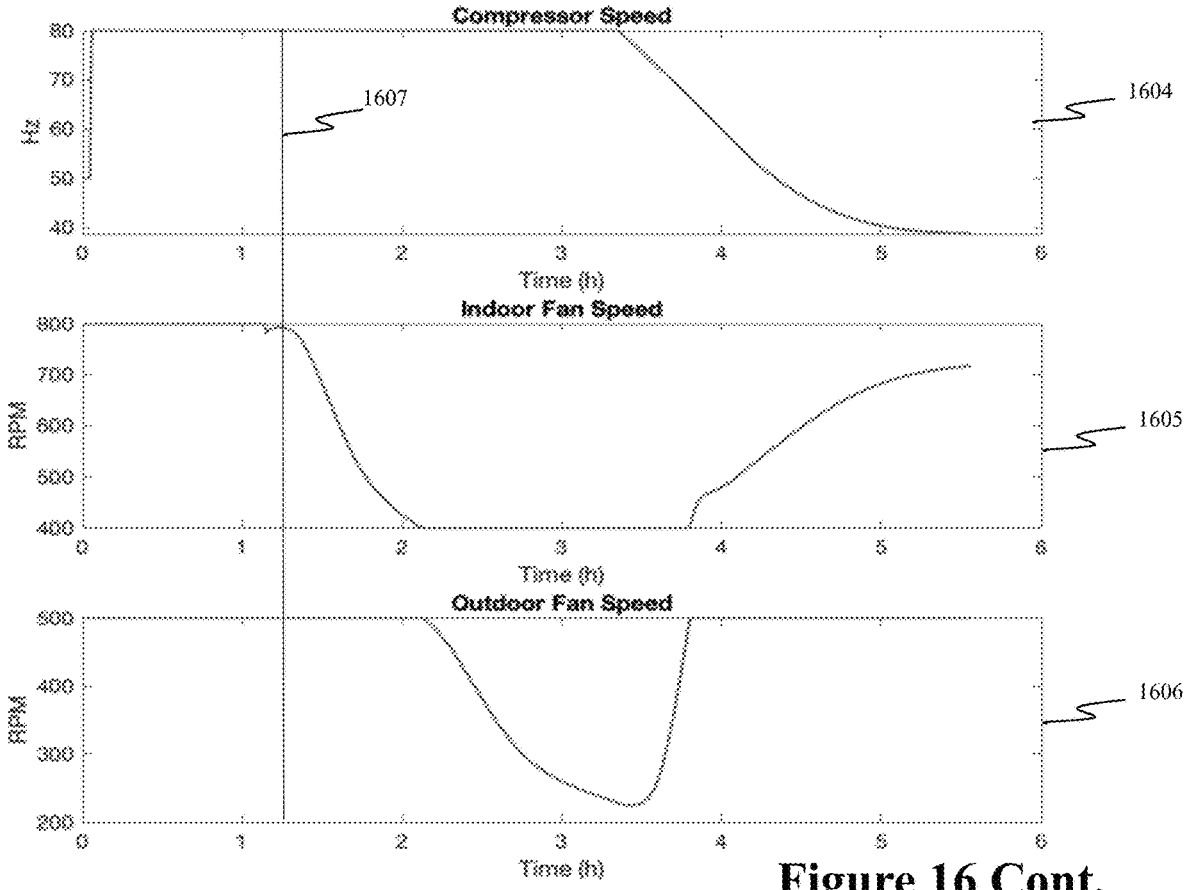

FIG. 16 shows result of a computer simulation of a particular heat pump model that is connected to an adiabatic room model with a constant sensible heat disturbance $Q_s$=1.5 kW, a constant latent heat $Q_l$=1 kW, and initial air temperature of 35° C. at 70% relative humidity, according to some embodiments of the present disclosure. A desired setpoint was 22° C. at 50% relative humidity. The heat pump started in the cooling mode, and the compressor compensator drove CF 1604 to its maximum limit within a few minutes, while the fan speed compensator drove both IFS 1605 and OFS 1606 to their maximum limits. The conditioned space temperature $T_r$ 1601 was driven down while the conditioned space relative humidity $\phi_r$ 1602 increased, as $\rho\rightarrow 0$. When $\rho=0$, at time 1607, the heat pump switched automatically to the reheat mode. Immediately after the switch, an evaporator temperature 1603 dropped approximately 8° C., which increased the heat pump latent heat capacity. Both the conditioned space temperature and conditioned space humidity were driven to their setpoints simultaneously at 3.3 h. Note that the IFS 1605 was modulated by the fan speed compensator to its minimum limit, at which time the OFS 1606 was modulated, to maintain $\rho\approx 0$ during transient, by the second feedback loop.

Figure 17:
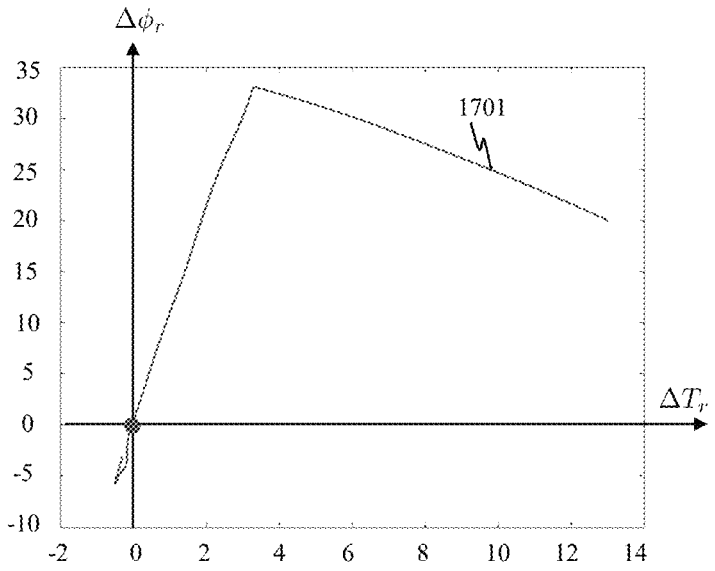
FIG. 17 shows a trajectory from the same computer simulation of FIG. 16, plotted in ($\Delta T$, $\Delta\phi$) coordinates, according to some embodiments.

FIG. 17 shows a trajectory 1701 from the same computer simulation plotted in ($\Delta T$, $\Delta\phi$) coordinates, according to some embodiments. The cooling mode drives the heat pump to $\rho=0$ locus, at which point the reheat mode was engaged automatically. In the reheat mode, the fan speed compensator maintained $\rho\approx 0$ while the compressor compensator drove the heat pump through origin, achieving simultaneous regulation of the conditioned space temperature and relative humidity, and avoiding overcooling.

Figure 18:
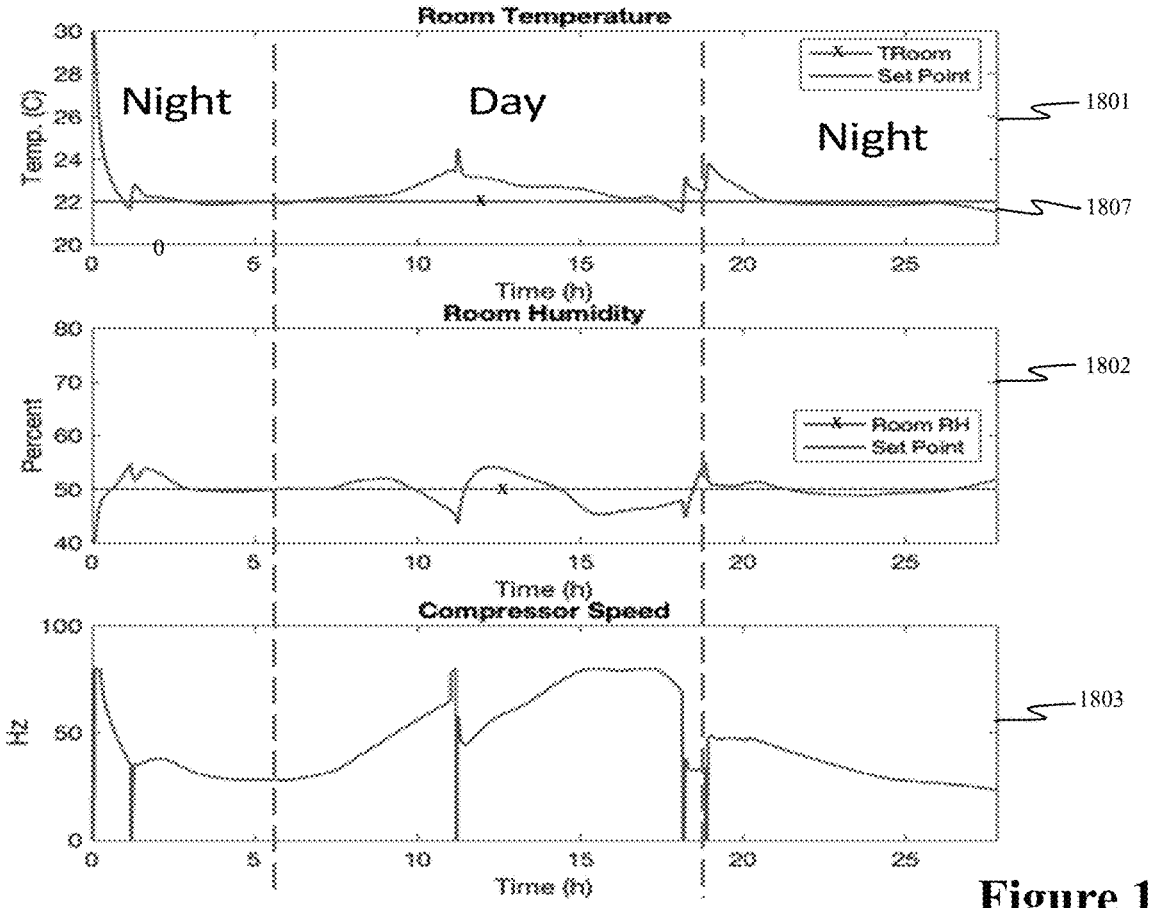
FIG. 18 shows results of a simulation of a multi-mode heat pump including a condenser reheat heat exchanger coil, according to an embodiment of the present disclosure.
Figure 18:
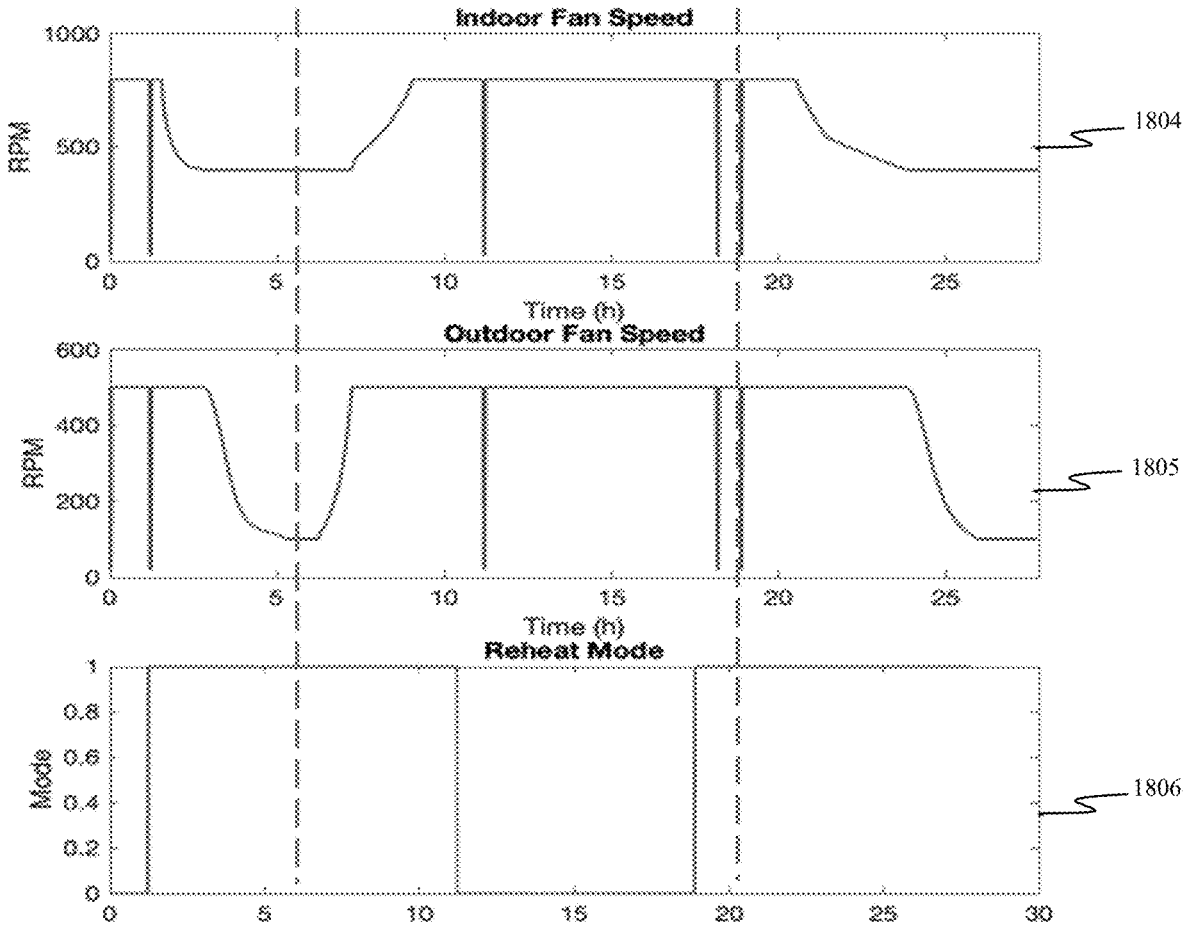

FIG. 18 shows results of simulation of a repeat of the conditions simulated in FIG. 1, but with the heat pump with the condenser reheat heat exchanger coil 610, according to an embodiment of the present disclosure. In this embodiment, the mode controller 626 provided for the off mode to be intermediate between a transition between the cooling mode and the reheat mode. The simulation results show effectiveness of the reheat mode 1806 in regulating a conditioned space temperature 1801 and relative humidity 1802, a compressor speed 1803, an IFS 1804, and an OFS 1805. The conditioned space relative humidity 1802 is maintained below 55%. The IFS 1804 and OFS 1805 were used to maintain $\rho\approx 0$, but in some extreme conditions during the second night 1807 both the IFS and OFS saturated at their minimum values, so p feedback loop opened. In these conditions, it was not possible to regulate both o and $\rho$ to their setpoints with a zero error, but the error is small.

EXEMPLARY EMBODIMENTS

Figure 19:
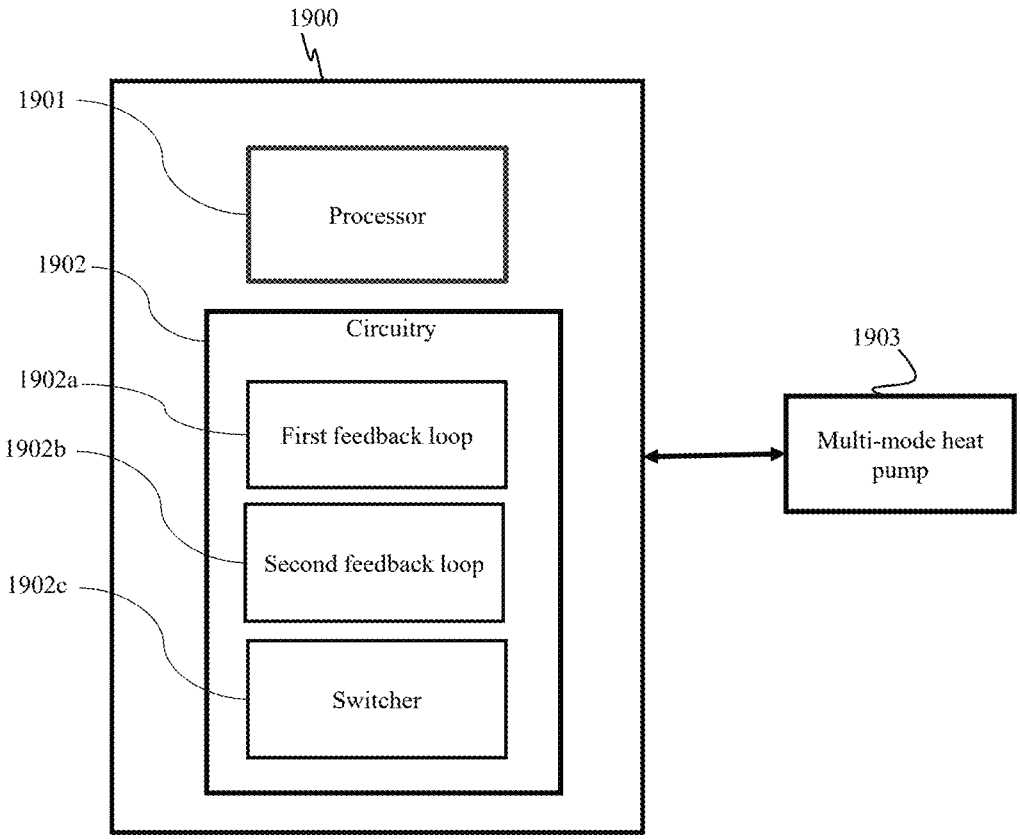
FIG. 19 illustrates a feedback controller for controlling a multi-mode heat pump, according to some embodiments of the present disclosure.

FIG. 19 illustrates a feedback controller 1900 for controlling a multi-mode heat pump 1903, according to some embodiments of the present disclosure. The feedback controller 1900 is communicatively coupled to the multi-mode heat pump 1903. The multi-mode heat pump 1903 includes the outdoor unit 601 and the indoor unit 602 that are described above in FIG. 6. The multi-mode heat pump 1903 further includes a vapor compression cycle configured to operate the multi-mode heat pump 1903 in the cooling mode or the reheat mode to condition a space (for example, conditioned space 604).

The multi-mode heat pump 1903 includes a processor 1901 and a circuitry 1902 forming modules of the feedback controller 1900. The processor 1901 may be a single core processor, a multi-core processor, a computing cluster, or any number of other configurations. The modules include a first feedback loop 1902*a*, a second feedback loop 1902*b*, and a switcher 1902*c*. In some embodiments, the feedback controller 1900 includes a memory (not shown in FIG. 19) that may be configured to store computer executable instructions forming the modules: the first feedback loop 1902*a*, the second feedback loop 1902*b*, and the switcher 1902*c*. The computer executable instructions stored in the memory is executed by the processor 1901 to execute the modules. The memory may include random access memory (RAM), read only memory (ROM), flash memory, or any other suitable memory systems. Additionally, in some embodiments, the memory may be implemented using a hard drive, an optical drive, a thumb drive, an array of drives, or any combinations thereof.

The processor 1901 is configured to compute the first psychrometric variable $\sigma$ and the second psychrometric variable $\rho$ based on a current temperature, a setpoint temperature, a current relative humidity, and a setpoint relative humidity of the space, via the psychrometric coordinate transformation P. The current temperature, the setpoint temperature, the current relative humidity, and the setpoint relative humidity correspond to the measured conditioned space temperature $T_r$ 1403, the setpoint for conditioned space temperature $\overline{T}_r$ 1401, the measured conditioned space relative humidity $\phi_r$ 1404, and the setpoint for conditioned space relative humidity $\overline{\phi}_r$ 1402, respectively. In an embodiment, the setpoint temperature and the setpoint relative humidity are received from a thermostat operatively connected to the feedback controller 1900.

In particular, the processor 1901 is configured to compute the first and second psychrometric variables ($\sigma$, $\rho$) as a function of $T_r$, $\overline{T}_r$, $\phi_r$ and $\overline{\phi}_r$ via the psychrometric coordinate transformation P, according to equations (2), (3) and (4).

The first feedback loop 1902*a* is configured to control, based on the first psychrometric variable, at least one of an expansion valve (for example, EEV 608) and a speed of a compressor (for example, compressor 605) of the multi-mode heat pump to reduce a magnitude of the first psychrometric variable to a predefined value. In an embodiment, the predefined value corresponds to zero. In some other embodiments, the predefined value corresponds to a value near to zero. The second feedback loop 1902*b* is configured to control, based on the second psychrometric variable, a speed of at least one of an outdoor fan (for example, outdoor fan 607) and an indoor fan (for example, indoor fan 611) of the multi-mode heat pump to reduce a magnitude of the second psychrometric variable to the predefined value. In some embodiments, the predefined value may be different for the first psychrometric variable and the second psychrometric variable.

The switcher 1902*c* is configured to operate the vapor compression cycle of the multi-mode heat pump in the cooling mode when the second psychrometric variable is greater than a threshold and the difference between the current temperature and the setpoint temperature is greater than the threshold. In an embodiment, the threshold corresponds to zero. In some other embodiments, the threshold corresponds to a value near to zero. Further, the switcher 1901*c* is further configured to operate the vapor compression cycle of the multi-mode heat pump in the reheat mode when the first psychrometric variable is greater than the threshold and the second psychrometric variable is less than the threshold.

Figure 20:
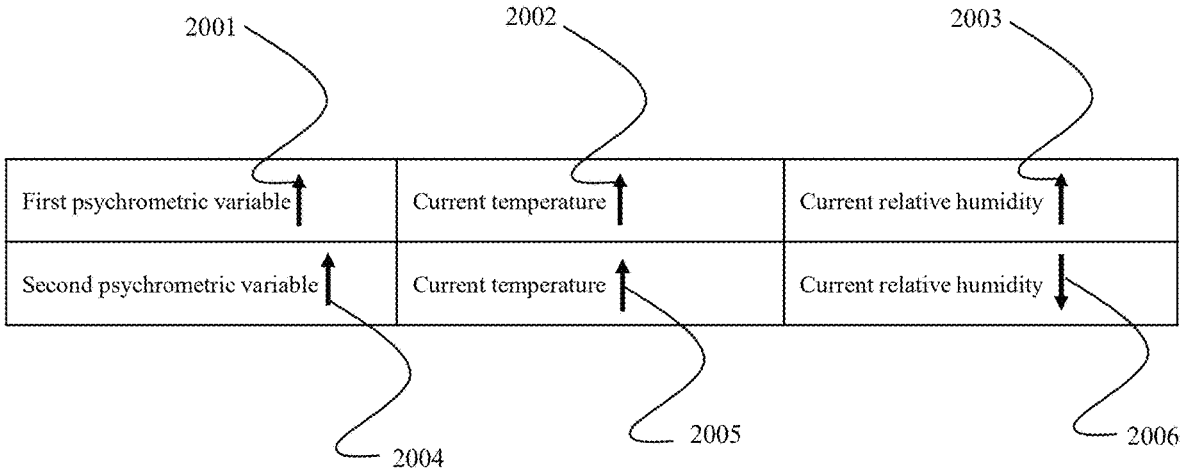
FIG. 20 illustrates relations among a first psychrometric variable, a second psychrometric variable, a current temperature and a current relative humidity, according to some embodiments of the present disclosure.
Figure 21:
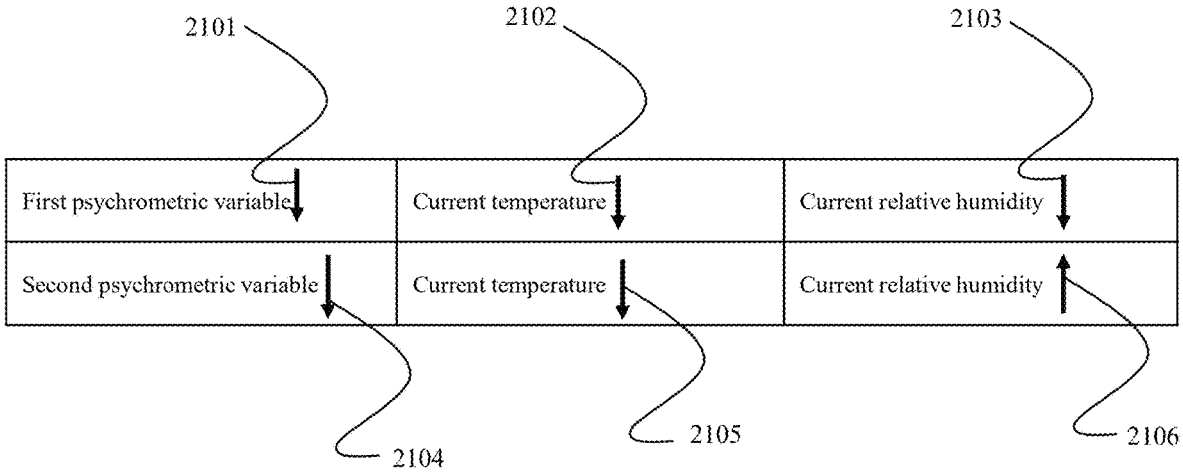
FIG. 21 illustrates relations among a first psychrometric variable, a second psychrometric variable, a current temperature and a current relative humidity, according to some other embodiments of the present disclosure.

FIGS. 20 and 21 illustrate relations among the first psychrometric variable, the second psychrometric variable, the current temperature and the current relative humidity, according to some embodiments of the present disclosure. Equations (3) and (4) mean that, for given values of setpoint temperature $\overline{T}_r$ and setpoint relative humidity $\overline{\phi}_r$, either (i) the first psychrometric variable increases 2001 when the current temperature increases 2002 and the current relative humidity increases 2003, and the second psychrometric variable increases 2004 when the current temperature increases 2005 and the current relative humidity decreases 2006, or (ii) the first psychrometric variable decreases 2101 when the current temperature decreases 2102 and the current relative humidity decreases 2103, and the second psychrometric variable decreases 2104 when the current temperature decreases 2105 and the current relative humidity increases 2106.

Any variables ($\sigma$, $\rho$) that satisfy one of these two conditions (i) and (ii) are denoted as the psychrometric variables. The psychrometric variables also satisfy $\rho=0$ and $\sigma=0$ when $T_r=\overline{T}_r$ and $\phi_r=\overline{\phi}_r$, which is implied by equation (2).

Figure 22A:
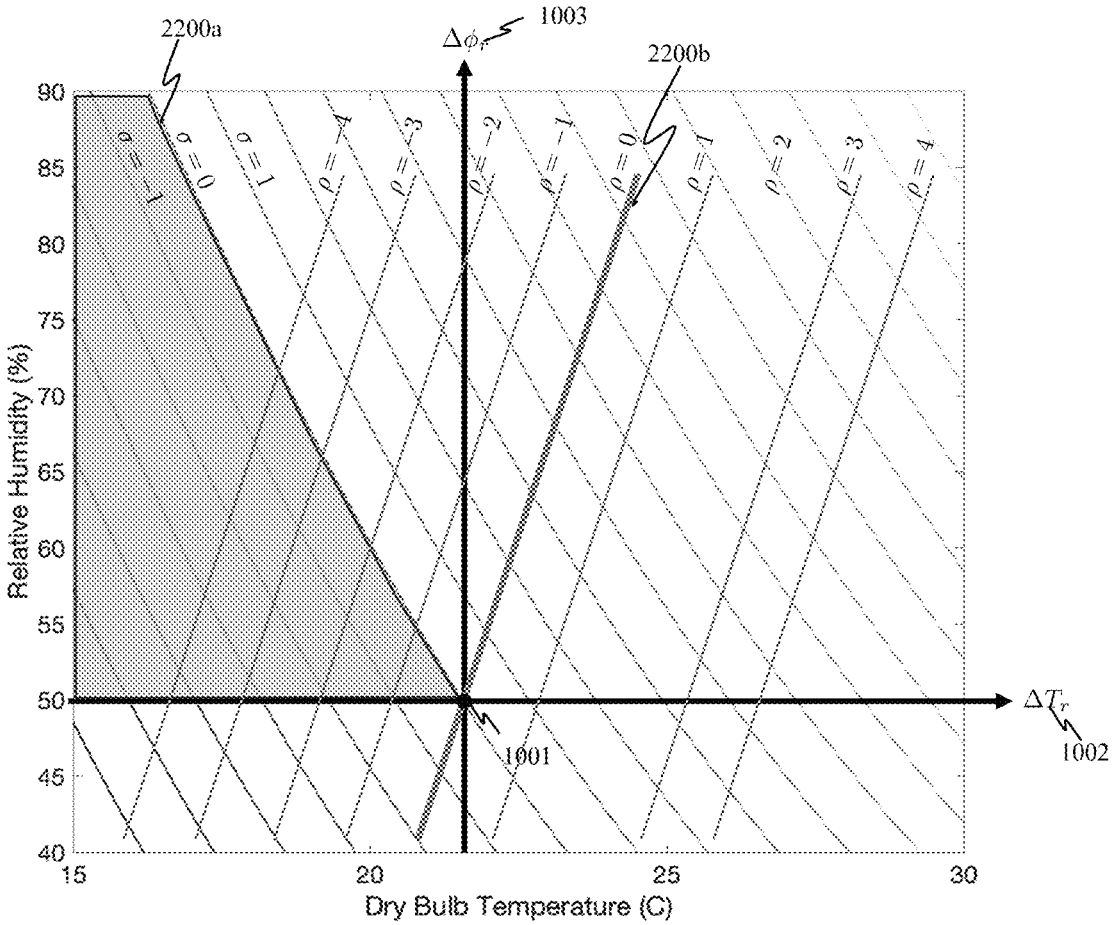
FIG. 22A illustrates an embodiment of the psychrometric variables ($\sigma$, $\rho$) plotted on a ($\Delta T_r$, $\Delta\varphi_r$)-plane in which a horizontal axis corresponds to a conditioned space temperature setpoint error and a vertical axis corresponds to the conditioned space relative humidity setpoint error, according to some embodiments of the present disclosure.

FIG. 22A illustrates an embodiment of the psychrometric variables ($\sigma$, $\rho$) plotted on the ($\Delta T_r$, $\Delta\phi_r$)-plane in which the horizontal axis corresponds to the conditioned space temperature setpoint error $\Delta T_r$ 1002 and the vertical axis corresponds to the conditioned space relative humidity setpoint error $\Delta\phi_r$ 1003, according to some embodiments of the present disclosure. The origin 1001 of the ($\Delta T_r$, $\Delta\phi_r$)-plane is defined by the setpoint temperature $\overline{T}_r$ and the setpoint relative humidity $\overline{\phi}_r$. The psychrometric coordinate transformation generates a first psychrometric variable contour $\sigma=0$ 2200*a* and a second psychrometric variable contour $\rho=0$ 2200*b*. The first psychrometric variable contour 2200*a* and the second psychrometric variable contour 2200*b* pass through the origin 1001. Such a transformation ensures that the psychrometric variables lie on the first psychrometric variable contour 2200*a* and the second psychrometric variable contour 2200*b* that pass through the origin 1001. In this embodiment, the first psychrometric variable $\sigma$ is defined as a difference between a wet bulb temperature of the space and a setpoint wet bulb temperature, according to aforementioned equation (5).

The wet bulb temperature of the space is determined as a function $f_{wb}$ of the current temperature and the current relative humidity and the setpoint wet bulb temperature is determined as a function $f_{wb}$ of the setpoint temperature and the setpoint relative humidity.

Further, the second psychrometric variable is defined according to equation (7). FIG. 22B illustrates equation (7) for defining the second psychrometric variable $\rho$, according to some embodiments of the present disclosure. The second psychrometric variable $\rho$ is defined as a difference between (i) a difference 2201 between the current temperature $T_r$ and the setpoint temperature $\overline{T}_r$ and (ii) a product of a positive constant $\alpha$ 2202 and a difference 2203 between the current relative humidity $\phi$ and the setpoint relative humidity $\overline{\phi}$.

Figure 23:
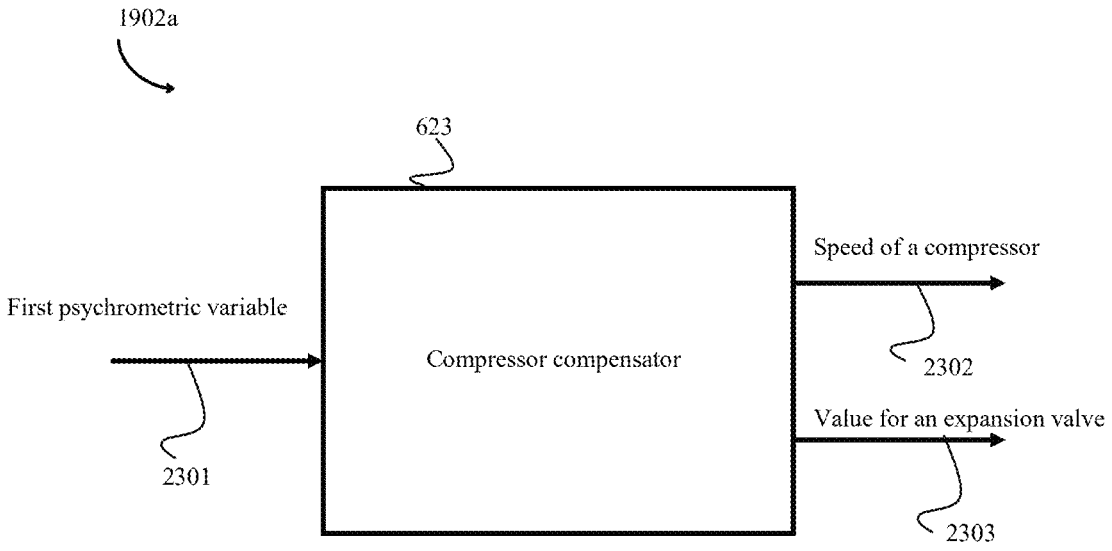
FIG. 23 illustrates the first feedback loop compensator, according to some other embodiments of the present disclosure.

FIG. 23 illustrates the first feedback loop 1902*a*, according to some embodiments of the present disclosure. The first feedback loop 1902*a* includes the compressor compensator 623. The compressor compensator 623 is configured to determine, based on a first psychrometric variable 2301, a speed 2302 of the compressor and a value 2303 for the expansion valve.

Figure 24A:
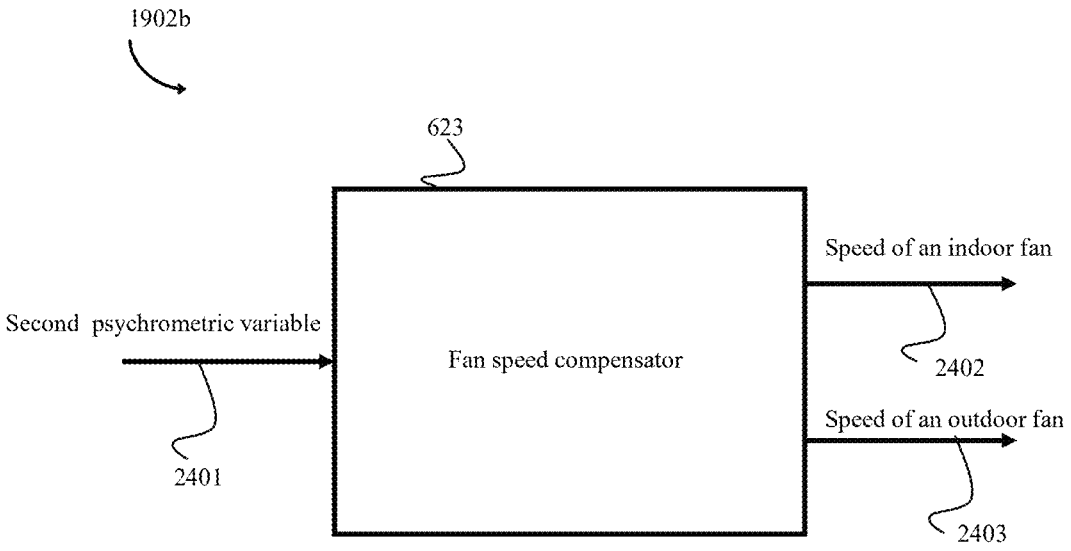
FIG. 24A illustrates the second feedback loop compensator, according to some other embodiments of the present disclosure.

FIG. 24A illustrates the second feedback loop 1902*b*, according to some embodiments of the present disclosure. The second feedback loop 1902*b* includes the fan speed compensator 624. The fan speed compensator 624 is configured to determine, based on a second psychrometric variable 2401, a speed 2402 the indoor fan and a speed 2403 of the outdoor fan.

Figure 24B:
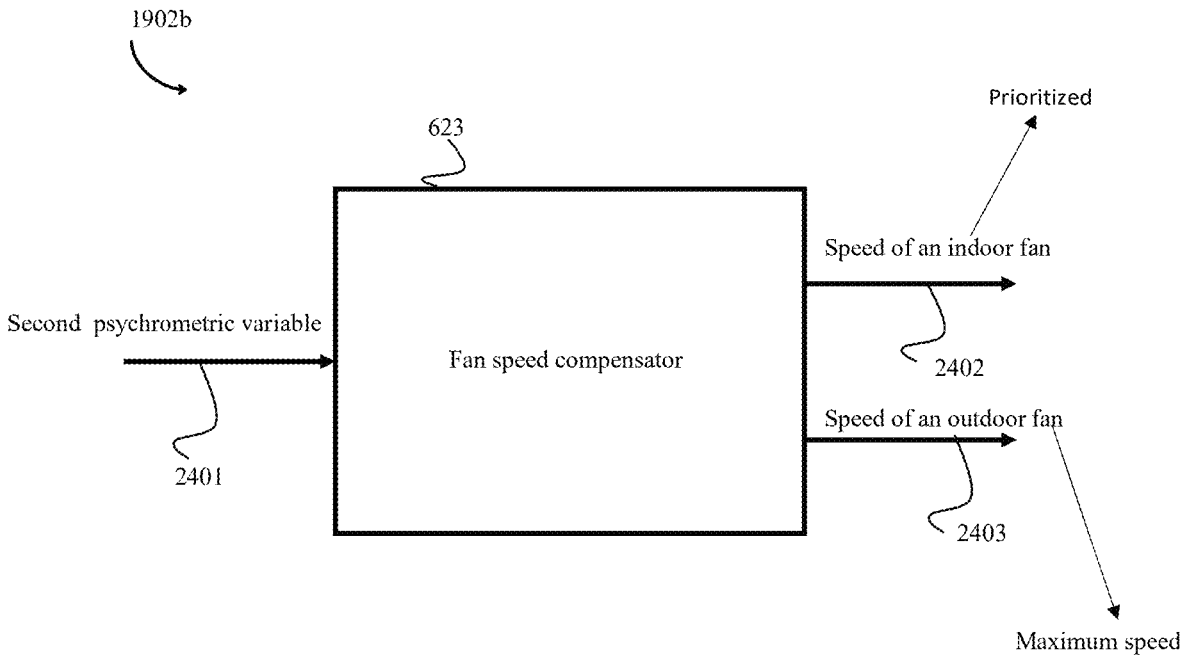
FIG. 24B illustrates the second feedback loop compensator, according to yet some other embodiments of the present disclosure.

FIG. 24B illustrates the second feedback loop 1902*b*, according to some other embodiments of the present disclosure. The fan speed compensator 624 is configured to prioritize the speed 2402 of the indoor fan over the speed 2403 of the outdoor fan. For instance, the fan speed compensator 624 is configured to determine, based on the second psychrometric variable 2401, the speed 2402 of the indoor fan and the speed 2403 of the outdoor fan in a prioritized manner such that the indoor fan speed 2402 is within a range of allowable speeds while the speed 2403 of the outdoor fan is at its maximum speed.

In some embodiments, the fan speed compensator 624 includes the Proportional-Integral compensator with anti-windup (PIaw) and limiter 1315, which has a minimum value corresponding to the minimum indoor fan speed plus the minimum outdoor fan speed, and a maximum value corresponding to the maximum indoor fan speed plus the maximum outdoor fan speed.

The vapor compression cycle of the multi-mode heat pump is controlled according to the speed 2302 of the compressor, the value 2303 for the expansion valve, the speed 2402 of the indoor fan, and the speed 2403 of the outdoor fan. Further, the vapor compression cycle of the multi-mode heat pump may be operated in a cooling mode or a reheat mode.

Figure 25:
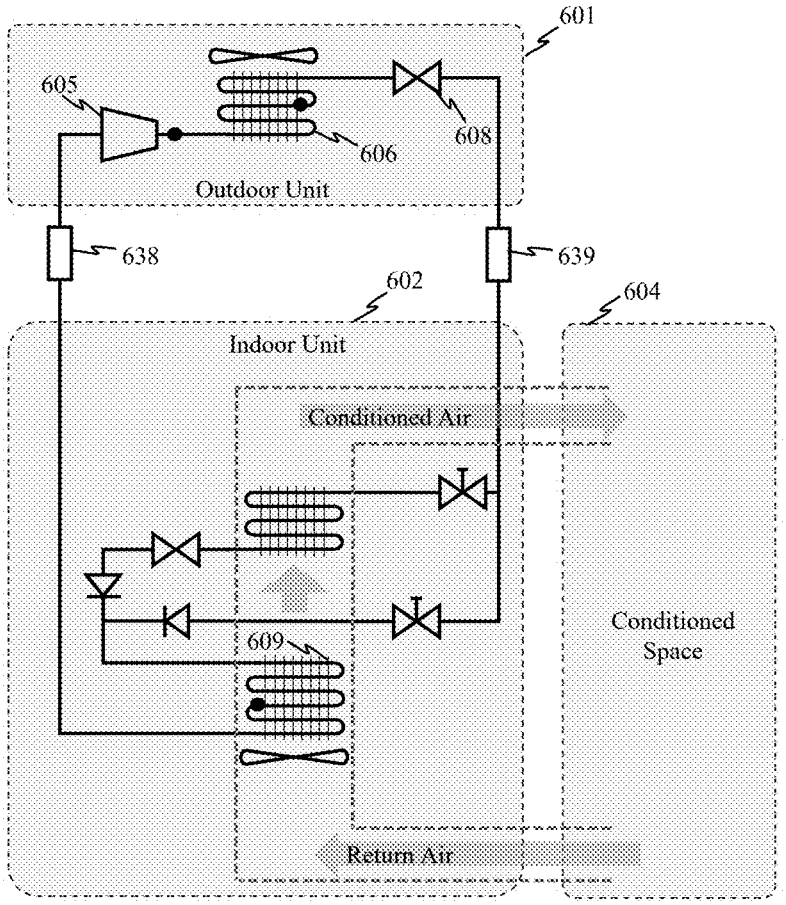
FIG. 25 illustrates a multi-mode heat pump operating in a cooling mode, according to an embodiment of the present disclosure.

FIG. 25 illustrates an operation of the vapor compression cycle of a multi-mode heat pump in a cooling mode, according to an embodiment of the present disclosure. The multi-mode heat pump includes the outdoor unit 601 and the indoor unit 602. The outdoor unit 601 and the indoor unit 602 are connected via the pipes 638 and 639. The outdoor unit 601 includes the compressor 605, the outdoor heat exchanger coil 606, and the expansion valve 608. The compressor 605 is configured to compress refrigerant vapor flowing in to the compressor 605. The outdoor heat exchanger coil 606 is configured to condese the compressed refrigerant into liquid refrigerant. The expansion valve 608 is configured to decrease a temperature and a pressure of the liquid refrigerant.

Further, the indoor unit 602 includes the indoor heat exchanger coil 609. The indoor heat exchanger coil 609 is configured to absorb heat from the conditioned space 604 into the liquid refrigerant that is of the decreased temperature and pressure to cool the conditioned space 604.

Figure 26:
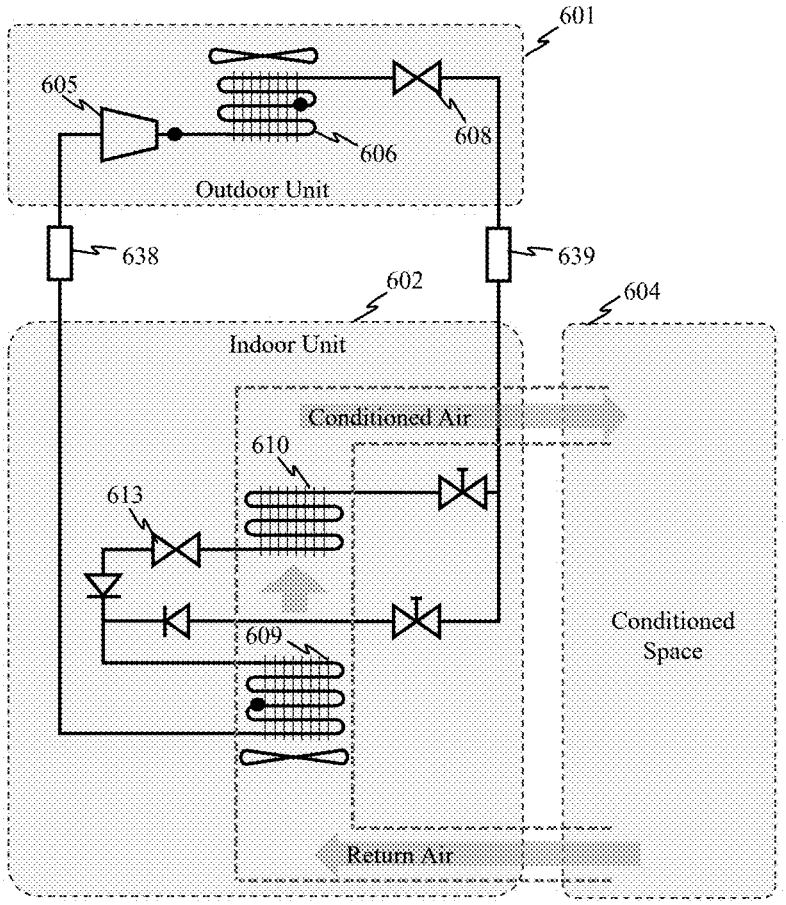
FIG. 26 illustrates a multi-mode heat pump operating in a reheat mode, according to an embodiment of the present disclosure.

FIG. 26 illustrates an operation of the vapor compression cycle of a multi-mode heat pump in a reheat mode, according to an embodiment of the present disclosure. The indoor unit 602 includes the indoor heat exchanger coil 609, the condenser reheat heat exchanger coil 610, and the indoor expansion valve 613. The condenser reheat heat exchanger coil 610 is configured to heat an air stream supplying the conditioned space 604 via the liquid refrigerant that is flowing though the condenser reheat heat exchanger coil 610. The indoor expansion valve 613 is configured to reduce a temperature and pressure of the refrigerant from the condenser reheat heat exchanger coil 610 to expand the refrigerant. The indoor heat exchanger coil 609 is configured to absorb the heat from the conditioned space 604 into the expanded refrigerant.

Figure 27:
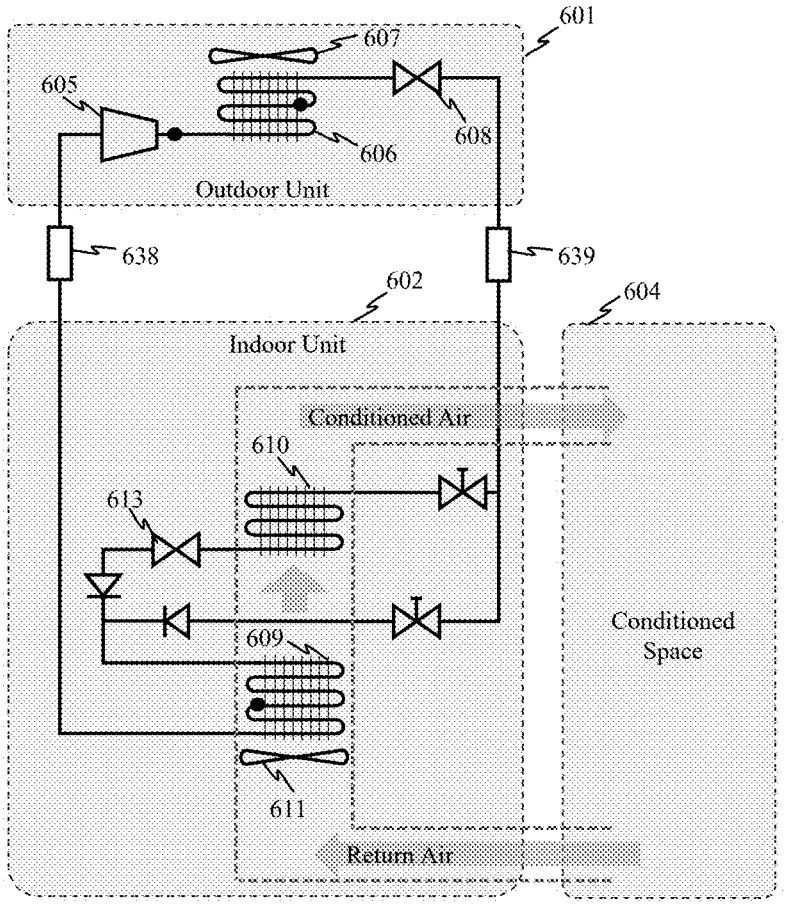
FIG. 27 illustrates a multi-mode heat pump operating in an off mode, according to an embodiment of the present disclosure.

Additionally, in some embodiments, the vapor compression cycle of a multi-mode heat pump may be operated in an off mode. FIG. 27 illustrates an operation of the vapor compression cycle of the multi-mode heat pump in an off mode, according to an embodiment of the present disclosure. In some embodiments, the switcher 1902*c* is further configured to operate the vapor compression cycle of the multi-mode heat pump in an off mode when the first psychrometric variable is less than the threshold and the difference between the current relative humidity and the setpoint relative humidity is less than the threshold. To operate the vapor compression cycle of the multi-mode heat pump in the off mode, the switcher 1902*c* is configured to turn off the compressor 605, the outdoor fan 607, and the indoor fan 611. In other words, in an off mode, the compressor 605, the outdoor fan 607, and the indoor fan 611 are in off state. Additionally, in some embodiments, the switcher 1902*c* includes a hysteresis component configured to provide hysterisis for preventing rapid switching among a cooling mode, a reheat mode, and an off mode. Some embodiments may incorporate timing constraints or limits into the switcher 1902*c* to maintain operation in a particular mode for a period of time.

Figure 28:
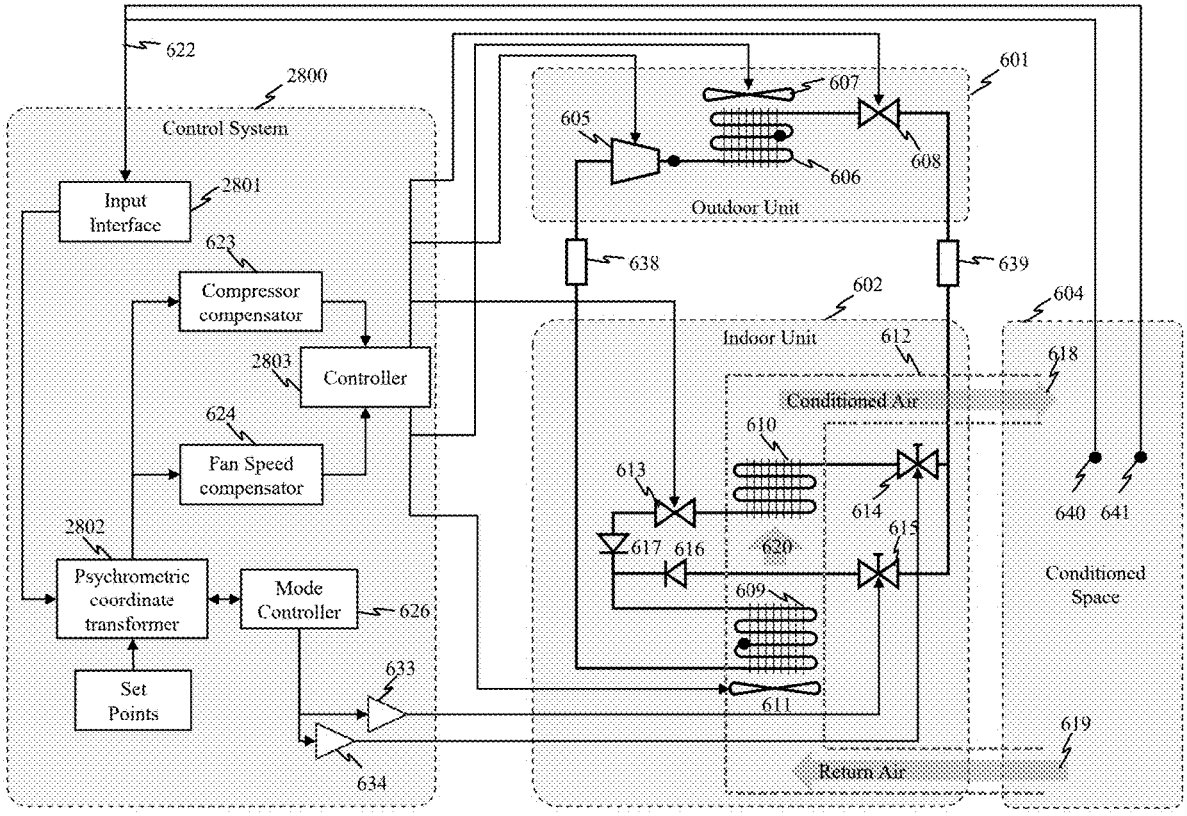
FIG. 28 illustrates a control system for controlling a multi-mode heat pump, according to an embodiment of the present disclosure.

FIG. 28 illustrates a control system 2800 for controlling a multi-mode heat pump, according to an embodiment of the present disclosure. The control system 2800 comprises an input interface 2801, a psychrometric coordinate transformer 2802, a controller 2803, a compressor compensator 623, the fan speed compensator 624, and a mode controller 626.

The input interface 2801 is configured to receive the current temperature, the setpoint temperature, the current relative humidity, and the setpoint relative humidity of the space. The psychrometric coordinate transformer 2802 is configured to determine the first psychrometric variable and the second psychrometric variable based on the current temperature, the setpoint temperature, the current relative humidity, and the setpoint relative humidity of the space, via the psychrometric coordinate transformation.

The first psychrometric variable is input to the compressor compensator 623. The compressor compensator 623 is configured to determine, based on the first psychrometric variable, a speed of the compressor 605 and a value for each of the indoor expansion valve 613 and the outdoor expansion valve 608.

The second psychrometric variable is input to the fan speed compensator 624. The fan speed compensator 624 is configured to determine, based on the second psychrometric variable, a speed of the indoor fan 611 and a speed of the outdoor fan 607.

The controller 2803 is configured to control the compressor 605, the indoor expansion valve 613, and outdoor the expansion valve 608 based on the determined speed of the compressor 605 and the value for each of the indoor expansion valve 613 and the outdoor expansion valve 608, to reduce the magnitude of the first psychrometric variable to a predefined value. The controller 2803 is further configured to control the indoor fan 611 and the outdoor fan 607 based on the determined speed of the indoor fan 611 and the speed of the outdoor fan 607, respectively, to reduce the magnitude of the second psychrometric variable to a predefined value.

The mode controller 626 is configured to operate the heat pump in the cooling mode when the second psychrometric variable is greater than the threshold and the difference between the current temperature and the setpoint temperature is greater than the threshold. The mode controller 626 is further configured to operate the heat pump in a reheat mode when the first psychrometric variable is greater than a threshold and the second psychrometric variable is less than a threshold.

Figure 29:
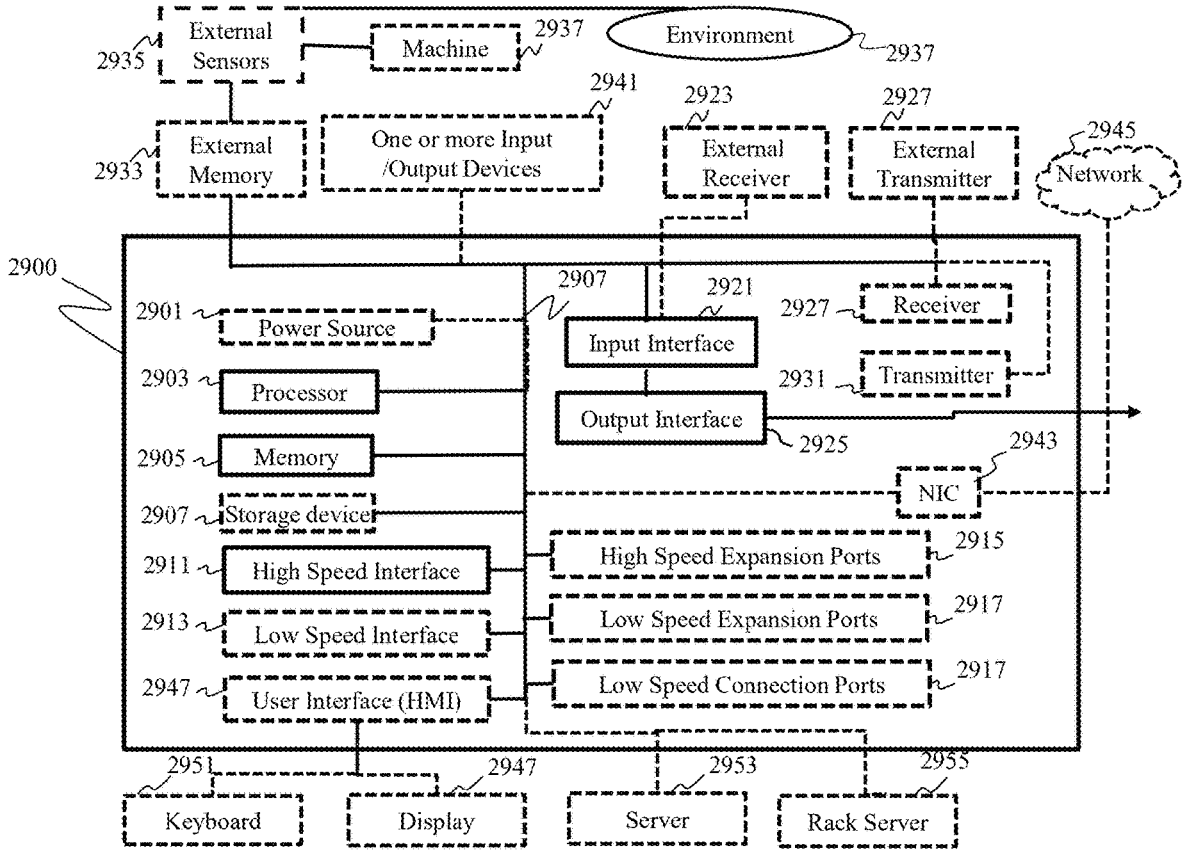
FIG. 29 is a schematic illustrating by non-limiting example a computing apparatus for implementing the methods and the systems of the present disclosure.

FIG. 29 is a schematic illustrating by non-limiting example a computing apparatus for implementing the methods and the systems of the present disclosure. The computing device 2900 can include a power source 2901, a processor 2903, a memory 2905, a storage device 2907, all connected to a bus 2909. Further, a high-speed interface 2911, a low-speed interface 2913, high-speed expansion ports 2915 and low speed connection ports 2917, can be connected to the bus 2909. In addition, a low-speed expansion port 2919 is in connection with the bus 2909. Further, an input interface 2921 can be connected via the bus 2909 to an external receiver 2923 and an output interface 2925. A receiver 2927 can be connected to an external transmitter 2929 and a transmitter 2931 via the bus 2909. Also connected to the bus 2909 can be an external memory 2933, external sensors 2935, machine(s) 2937, and an environment 2939. Further, one or more external input/output devices 2941 can be connected to the bus 2909. A network interface controller (NIC) 2943 can be adapted to connect through the bus 2909 to a network 2945, wherein data or other data, among other things, can be rendered on a third-party display device, third party imaging device, and/or third-party printing device outside of the computer device 2900.

The memory 2905 can store instructions that are executable by the computer device 2900, historical data, and any data that can be utilized by the methods and systems of the present disclosure. The memory 2905 can include random access memory (RAM), read only memory (ROM), flash memory, or any other suitable memory systems. The memory 2905 can be a volatile memory unit or units, and/or a non-volatile memory unit or units. The memory 2905 may also be another form of computer-readable medium, such as a magnetic or optical disk.

The storage device 2907 can be adapted to store supplementary data and/or software modules used by the computer device 2900. For example, the storage device 2907 can store historical data and other related data as mentioned above regarding the present disclosure. Additionally, or alternatively, the storage device 2907 can store historical data like data as mentioned above regarding the present disclosure. The storage device 2907 can include a hard drive, an optical drive, a thumb-drive, an array of drives, or any combinations thereof. Further, the storage device 2907 can contain a computer-readable medium, such as a floppy disk device, a hard disk device, an optical disk device, or a tape device, a flash memory or other similar solid-state memory device, or an array of devices, including devices in a storage area network or other configurations. Instructions can be stored in an information carrier. The instructions, when executed by one or more processing devices (for example, the processor 2903), perform one or more methods, such as those described above.

The computing device 2900 can be linked through the bus 2909, optionally, to a display interface or user Interface (HMI) 2947 adapted to connect the computing device 2900 to a display device 2949 and a keyboard 2951, wherein the display device 2949 can include a computer monitor, camera, television, projector, or mobile device, among others. In some implementations, the computer device 2900 may include a printer interface to connect to a printing device, wherein the printing device can include a liquid inkjet printer, solid ink printer, large-scale commercial printer, thermal printer, UV printer, or dye-sublimation printer, among others.

The high-speed interface 2911 manages bandwidth-intensive operations for the computing device 2900, while the low-speed interface 2913 manages lower bandwidth-intensive operations. Such allocation of functions is an example only. In some implementations, the high-speed interface 2911 can be coupled to the memory 2905, the user interface (HMI) 2947, and to the keyboard 2951 and the display 2949 (e.g., through a graphics processor or accelerator), and to the high-speed expansion ports 2915, which may accept various expansion cards via the bus 2909. In an implementation, the low-speed interface 2913 is coupled to the storage device 2907 and the low-speed expansion ports 2917, via the bus 2909. The low-speed expansion ports 2917, which may include various communication ports (e.g., USB, Bluetooth, Ethernet, wireless Ethernet) may be coupled to the one or more input/output devices 2941. The computing device 2900 may be connected to a server 2953 and a rack server 2955. The computing device 2900 may be implemented in several different forms. For example, the computing device 2900 may be implemented as part of the rack server 2955.

The description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, understood by one of ordinary skill in the art can be that the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically, the functionality of the program modules may be combined or distributed as desired in various embodiments.

Embodiments of the present disclosure may be embodied as a method, of which an example has been provided. The acts performed as part of the method may be ordered in any suitable way. Accordingly, embodiments may be constructed in which acts are performed in an order different than illustrated, which may include performing some acts concurrently, even though shown as sequential acts in illustrative embodiments.

Further, embodiments of the present disclosure and the functional operations described in this specification can be implemented in digital electronic circuitry, in tangibly-embodied computer software or firmware, in computer hardware, including the structures disclosed in this specification and their structural equivalents, or in combinations of one or more of them. Further some embodiments of the present disclosure can be implemented as one or more computer programs, i.e., one or more modules of computer program instructions encoded on a tangible non transitory program carrier for execution by, or to control the operation of, data processing apparatus. Further still, program instructions can be encoded on an artificially generated propagated signal, e.g., a machine-generated electrical, optical, or electromagnetic signal, which is generated to encode information for transmission to suitable receiver apparatus for execution by a data processing apparatus. The computer storage medium can be a machine-readable storage device, a machine-readable storage substrate, a random or serial access memory device, or a combination of one or more of them.

According to embodiments of the present disclosure the term "data processing apparatus" can encompass all kinds of apparatus, devices, and machines for processing data, including by way of example a programmable processor, a computer, or multiple processors or computers. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, or a combination of one or more of them.

A computer program (which may also be referred to or described as a program, software, a software application, a module, a software module, a script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code.

A computer program can be deployed to be executed on one computer or on multiple computers that are located at one site or distributed across multiple sites and interconnected by a communication network. Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data.

Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

Although the present disclosure has been described with reference to certain preferred embodiments, it is to be understood that various other adaptations and modifications can be made within the spirit and scope of the present disclosure. Therefore, it is the aspect of the append claims to cover all such variations and modifications as come within the true spirit and scope of the present disclosure.

We claim:

1. A feedback controller for controlling a multi-mode heat pump having a vapor compression cycle configured to operate the multi-mode heat pump in a cooling mode or a reheat mode to condition a space, the feedback controller comprising:

a processor configured to compute a first psychrometric variable and a second psychrometric variable based on a current temperature, a setpoint temperature, a current relative humidity, and a setpoint relative humidity of the space, via a psychrometric coordinate transformation; and a circuitry forming modules of the feedback controller, the modules comprising:

a first feedback loop configured to control, based on the first psychrometric variable, at least one of an expansion valve and a speed of a compressor of the multi-mode heat pump to reduce a magnitude of the first psychrometric variable to a predefined value;

a second feedback loop configured to control, based on the second psychrometric variable, a speed of at least one of an outdoor fan and an indoor fan of the multi-mode heat pump to reduce a magnitude of the second psychrometric variable to a predefined value; and a switcher configured to operate the vapor compression cycle of the multi-mode heat pump in the cooling mode when the second psychrometric variable is greater than a threshold and the difference between the current temperature and the setpoint temperature is greater than the threshold, or the reheat mode when the first psychrometric variable is greater than a threshold and the second psychrometric variable is less than a threshold.

2. The feedback controller of claim 1, wherein the first psychrometric variable increases when the current temperature increases and the current relative humidity increases, and the second psychrometric variable increases when the current temperature increases and the current relative humidity decreases.

3. The feedback controller of claim 1, wherein the first psychrometric variable decreases when the current temperature decreases and the current relative humidity decreases, and the second psychrometric variable decreases when the current temperature decreases and the current relative humidity increases.

4. The feedback controller of claim 1, wherein the psychrometric coordinate transformation generates a first psychrometric variable contour and a second psychrometric variable contour that pass through an origin of a plane of temperature setpoint error and relative humidity setpoint error, wherein the origin is defined by the setpoint temperature and the setpoint relative humidity.

5. The feedback controller of claim 1, wherein the first psychrometric variable is defined as a difference between a wet bulb temperature of the space and a setpoint wet bulb temperature.

6. The feedback controller of claim 5, wherein the wet bulb temperature of the space is determined as a function of the current temperature and the current relative humidity.

7. The feedback controller of claim 5, wherein setpoint wet bulb temperature is determined as a function of the setpoint temperature and the setpoint relative humidity.

8. The feedback controller of claim 1, wherein the second psychrometric variable is defined as a difference between (i) a difference between the current temperature and the setpoint temperature and (ii) a product of a positive constant and a difference between the current relative humidity and the setpoint relative humidity.

9. The feedback controller of claim 1, wherein the first feedback loop includes a compressor compensator configured to determine, based on the first psychrometric variable, the speed of the compressor and a value for the expansion valve.

10. The feedback controller of claim 1, wherein the second feedback loop includes a fan speed compensator configured to determine, based on the second psychrometric variable, the speed of at least one of the indoor fan and the outdoor fan.

11. The feedback controller of claim 10, wherein the fan speed compensator is configured to determine, based on the second psychrometric variable, the speed of the indoor fan and the outdoor fan in a manner such that the indoor fan speed is within a range of allowable speeds while the speed of the outdoor fan is at its a maximum speed.

12. The feedback controller of claim 10, wherein the fan speed compensator includes a Proportional-Integral compensator.

13. The feedback controller of claim 1, wherein to operate the vapor compression cycle of the multi-mode heat pump in the cooling mode, the multi-mode heat pump comprises:

an outdoor unit including:

the compressor configured to compress refrigerant vapor;

an outdoor heat exchanger coil configured to condese the compressed refrigerant into liquid refrigerant; and the expansion valve configured to decrease a temperature and a pressure of the liquid refrigerant; and an indoor unit including:

an indoor heat exchanger coil configured to absorb heat from the space into the liquid refrigerant that is of the decreased temperature and pressure.

14. The feedback controller of claim 13, wherein to operate the vapor compression cycle of the multi-mode heat pump in the reheat mode, the vapor compression cycle comprises the indoor unit including:

a condenser reheat heat exchanger coil configured to heat an air stream supplying the conditioned space via the liquid refrigerant that is flowing though the condenser reheat heat exchanger coil;

an indoor expansion valve configured to reduce a temperature and pressure of the refrigerant from the condenser reheat heat exchanger coil to expand the refrigerant; and the indoor heat exchanger coil configured to absorb the heat from the space into the expanded refrigerant.

15. The feedback controller of claim 1, wherein the switcher is further configured to operate the vapor compression cycle of the multi-mode heat pump in an off mode when the first psychrometric variable is less than the threshold and a difference between the current relative humidity and the setpoint relative humidity is less than the threshold.

16. The feedback controller of claim 15, wherein to operate the vapor compression cycle of the multi-mode heat pump in the off mode, the switcher is further configured to turn off the compressor, the outdoor fan, and the indoor fan.

17. The feedback controller of claim 15, wherein the switcher includes a hysteresis component configured to provide hysterisis for preventing rapid switching among the cooling mode, the reheat mode, and the off mode.

18. The feedback controller of claim 1, wherein the setpoint temperature and the setpoint relative humidity are received from a thermostat operatively connected to the feedback controller.

19. A method for controlling a multi-mode heat pump having a vapor compression cycle configured to operate the multi-mode heat pump in a cooling mode or a reheat mode to condition a space, the method comprising:

computing a first first psychrometric variable and a second psychrometric variable based on a current temperature, a setpoint temperature, a current relative humidity, and a setpoint relative humidity of the space, via a psychrometric coordinate transformation;

controlling, based on the first psychrometric variable, at least one of an expansion valve and a speed of a compressor of the multi-mode heat pump to reduce a magnitude of the first psychrometric variable to a predefined value;

controlling, based on the second psychrometric variable, a speed of at least one of an outdoor fan and an indoor fan of the multi-mode heat pump to reduce a magnitude of the second psychrometric variable to the predefined value; and operating the vapor compression cycle of the multi-mode heat pump in the cooling mode when the second psychrometric variable is greater than a threshold and the difference between the current temperature and the setpoint temperature is greater than the threshold, or the reheat mode when the first psychrometric variable is greater than the threshold and the second psychrometric variable is less than the threshold.

20. A control system for controlling a heat pump configured to condition a space, wherein the heat pump includes an indoor unit and an outdoor unit, the indoor unit includes an indoor fan and an indoor expansion valve, and the outdoor unit includes a compressor, an outdoor fan, and an outdoor expansion valve, the control system comprising:

an input interface configured to receive a current temperature, a setpoint temperature, a current relative humidity, and a setpoint relative humidity of the space;

a psychrometric coordinate transformer configured to determine a first psychrometric variable and a second psychrometric variable based on the current temperature, the setpoint temperature, the current relative humidity, and the setpoint relative humidity of the space, via a psychrometric coordinate transformation;

a compressor compensator configured to determine, based on the first psychrometric variable, a speed of the compressor and a value for each of the indoor expansion valve and the outdoor expansion valve;

a fan speed compensator configured to determine, based on the second psychrometric variable, a speed of the indoor fan and a speed of the outdoor fan;

a controller configured to:

control the compressor, the indoor expansion valve, and the outdoor expansion valve based on the determined speed of the compressor and the value for each of the indoor expansion valve and the outdoor expansion valve, to reduce a magnitude of the first psychrometric variable to a predefined value; and control the indoor fan and the outdoor fan based on the determined speed of the indoor fan and the speed of outdoor fan, respectively, to reduce a magnitude of the second psychrometric variable to a predefined value; and a mode controller configured to operate the heat pump in a cooling mode when the second psychrometric variable is greater than a threshold and a difference between the current temperature and the setpoint temperature is greater than a threshold, or a reheat mode when the first psychrometric variable is greater than the threshold and the second psychrometric variable is less than a threshold.

* * * * *